US009915042B2

(12) United States Patent
Miles

(10) Patent No.: US 9,915,042 B2
(45) Date of Patent: Mar. 13, 2018

(54) MULTIPLE BURNER ZONE CONTROLLED ASPHALT HEATING HOOD

(71) Applicant: Cutler Repaving, Inc., Lawrence, KS (US)

(72) Inventor: John Miles, Lawrence, KS (US)

(73) Assignee: Cutler Repaving, Inc., Lawrence, KS (US)

( * ) Notice: Subject to any disclaimer, the term of this patent is extended or adjusted under 35 U.S.C. 154(b) by 184 days.

(21) Appl. No.: 14/942,016

(22) Filed: Nov. 16, 2015

(65) Prior Publication Data

US 2017/0138003 A1 May 18, 2017

(51) Int. Cl.

| | |
|---|---|
| ***E01C 23/14*** | (2006.01) |
| ***E01C 23/06*** | (2006.01) |
| ***F23C 99/00*** | (2006.01) |

(52) U.S. Cl.

CPC ..... *E01C 23/065* (2013.01); *E01C 23/14* (2013.01); *F23C 99/00* (2013.01); *E01C 2301/10* (2013.01)

(58) Field of Classification Search

CPC ..... E01C 23/14; E01C 2301/10
USPC ..... 404/95
See application file for complete search history.

(56) References Cited

U.S. PATENT DOCUMENTS

| | | | | |
|---|---|---|---|---|
| 2,086,469 A | | 7/1937 | Bullard | |
| 2,274,517 A | | 2/1942 | Ashmore | |
| 2,891,536 A | | 6/1959 | Ford | |
| 3,311,104 A | * | 3/1967 | Wollner | E01C 23/14 126/271.2 A |
| 3,331,297 A | * | 7/1967 | Bettino | E01C 19/238 404/131 |
| 3,361,042 A | | 1/1968 | Cutler | |
| 3,724,445 A | | 4/1973 | Cutler | |
| 3,801,212 A | | 4/1974 | Cutler | |
| 3,807,886 A | | 4/1974 | Cutler | |
| 3,865,098 A | | 2/1975 | Cutler | |
| 3,874,366 A | * | 4/1975 | Cutler | E01C 23/14 126/271.2 A |
| 3,907,450 A | | 9/1975 | Cutler | |
| 3,989,401 A | | 11/1976 | Moench | |
| 4,008,975 A | | 2/1977 | Cutler | |
| 4,011,023 A | | 3/1977 | Cutler | |
| 4,103,973 A | | 8/1978 | Cutler | |
| 4,124,325 A | | 11/1978 | Cutler | |

(Continued)

FOREIGN PATENT DOCUMENTS

FR 2349808 4/1976

OTHER PUBLICATIONS

European Search Report from European Patent Application Serial No. EP 16190313.3 (Search Report dated Mar. 3, 2017).

(Continued)

*Primary Examiner* — Gary S Hartmann
(74) *Attorney, Agent, or Firm* — Hovey Williams LLP

(57) ABSTRACT

A heating hood is operable to be advanced along a length of bituminous pavement to recycle at least part of the bituminous pavement. The heating hood includes a plurality of burners operable to combust a fuel so that each burner produces a heated exhaust stream. A lower margin of the heating hood is operable to discharge the heated exhaust streams onto the pavement, with the heated exhaust streams discharged from the lower discharge margin having no visible flame.

33 Claims, 21 Drawing Sheets

(56) References Cited

U.S. PATENT DOCUMENTS

| | | | | | |
|---|---|---|---|---|---|
| 4,397,263 | A * | 8/1983 | Rio | B28B 11/04 | 118/415 |
| 4,534,674 | A | 8/1985 | Cutler | | |
| 4,559,922 | A * | 12/1985 | Crupi | E01C 23/14 | 126/271.2 A |
| 4,561,800 | A | 12/1985 | Hatakenaka et al. | | |
| 4,711,600 | A | 12/1987 | Yates | | |
| 4,784,518 | A | 11/1988 | Cutler | | |
| 5,139,362 | A * | 8/1992 | Richter | E01C 19/48 | 404/95 |
| 5,791,814 | A | 8/1998 | Wiley | | |
| 5,895,171 | A | 4/1999 | Wiley et al. | | |
| 6,109,826 | A * | 8/2000 | Mertes | E01C 19/45 | 392/472 |
| 6,124,580 | A * | 9/2000 | Nottmeier | E01C 19/407 | 219/618 |
| 6,939,079 | B2 | 9/2005 | Lloyd | | |
| 7,300,225 | B2 * | 11/2007 | Musil | E01C 19/48 | 404/101 |
| 2003/0002922 | A1 * | 1/2003 | Boyer | E01C 19/40 | 404/95 |
| 2010/0104363 | A1 | 4/2010 | Benedetti | | |

OTHER PUBLICATIONS

Office Action from Canadian Serial No. 2,925,920 (dated May 1, 2017).

* cited by examiner

MULTIPLE BURNER ZONE CONTROLLED ASPHALT HEATING HOOD

BACKGROUND

1. Field

The present invention relates generally to paving systems. More specifically, embodiments of the present invention concern a paving vehicle that carries a heating hood with multiple burners.

2. Discussion of Prior Art

Paving vehicles have long been used to build and repair roads made of bituminous asphalt material. For instance, repaving vehicles have been used to repave an existing asphalt road by separating and recycling an uppermost layer of material from the road, adding new asphalt material to the recycled material, and reapplying the combined material to form a new uppermost layer of the road. Conventional repaving vehicles use a heating hood with a burner positioned above and in close proximity to the road surface to discharge a heated exhaust stream directly onto the existing road surface.

However, the heating hoods of conventional repaving vehicles has various deficiencies. For instance, conventional heating hoods are known to apply relatively more heat in the center of the hood and relatively less heat along the perimeter of the hood. Similarly, when exposed to substantial side winds, prior art heating hoods are known to apply heat in a nonuniform manner because the wind deflects the heated exhaust stream in the wind direction.

Conventional heating hoods are also deficient because the heated exhaust stream from the burner can overheat and degrade the existing road material. This problem is particularly acute for known heating hoods that discharge an exhaust flame directly on the road surface.

SUMMARY

The following brief summary is provided to indicate the nature of the subject matter disclosed herein. While certain aspects of the present invention are described below, the summary is not intended to limit the scope of the present invention.

Embodiments of the present invention provide a heating hood that does not suffer from the problems and limitations of the prior art repaving systems set forth above.

A first aspect of the present invention concerns a heating hood operable to be advanced along a length of bituminous pavement to recycle at least part of the bituminous pavement. The heating hood broadly includes a plurality of burners and a plurality of enclosures. The burners are operable to combust a fuel so that each burner produces a heated exhaust stream. The enclosures are operable to extend laterally along the pavement. Each of the enclosures presents a plenum that fluidly communicates with a corresponding one of the burners to receive the heated exhaust stream and distribute the heated exhaust stream laterally along the pavement. The enclosures are positioned laterally alongside one another and cooperatively presenting a lower margin of the heating hood operable to discharge the heated exhaust streams onto the pavement.

A second aspect of the present invention concerns a hot air heating hood operable to be advanced along a length of bituminous pavement to recycle at least part of the bituminous pavement. The heating hood assembly broadly includes a hood structure, a plurality of burners, and a plurality of elongated exhaust ducts. The hood structure defines a lower discharge margin operable to overlie the pavement. The burners are operable to combust a fuel so that each burner produces a heated exhaust stream. The exhaust ducts present duct outlets that fluidly communicate with the lower discharge margin. Each of the exhaust ducts fluidly communicates with a corresponding one of the burners to receive and carry the respective heated exhaust stream to the lower discharge margin, with the lower discharge margin being operable to discharge the heated exhaust streams onto the pavement.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
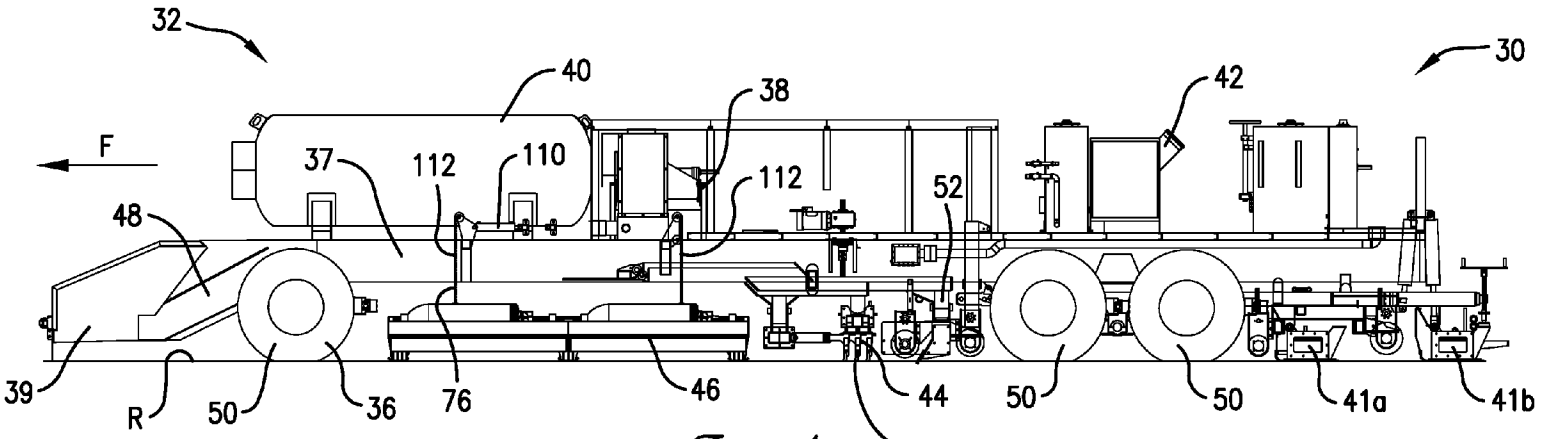
FIG. 1 is a fragmentary side elevation of a repaving system constructed in accordance with a preferred embodiment of the present invention, with a repaver vehicle of the repaving system being depicted and including a rolling chassis, a drive train, a fuel supply, an operator station, a scarifier assembly, a receiving hopper, a conveyor system, and a heating hood.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning to FIGS. 1-4, a repaving system 30 is constructed in accordance with a preferred embodiment of the present invention. The repaving system 30 is operable to repave an existing bituminous asphalt road R (see FIGS. 1 and 3) by separating and recycling an uppermost layer of material from the road R, adding new asphalt material to the recycled material, and reapplying the combined material to form a new uppermost layer of the road R. However, it will be appreciated that the repaving system 30 can be used to repave a road using various material formulations without departing from the scope of the present invention. The system 30 preferably includes a repaver vehicle 32 and a preheater vehicle 34.

Figure 2:
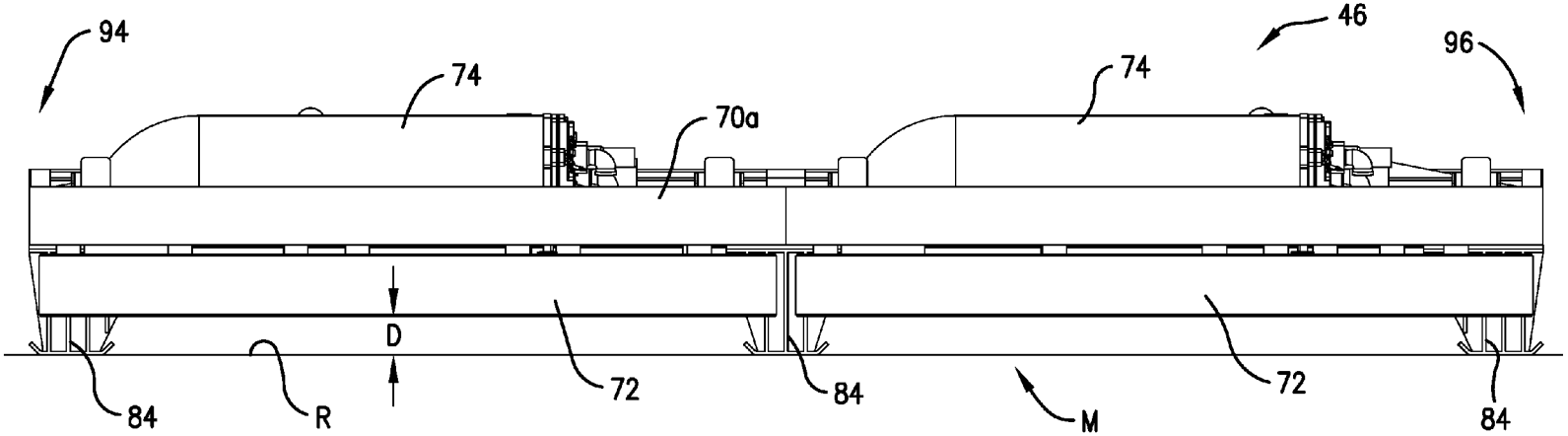
FIG. 2 is an enlarged fragmentary side elevation of the heating hood shown in FIG. 1, showing a hood frame, plenum enclosures, and burner assemblies of the heating hood.

Turning to FIGS. 1 and 2, the repaver vehicle 32 is preferably used to heat the road R, scarify the road R to separate material from the road R, add recycling agent to the separated material to form a recycled material, screed the recycled material into a recycled layer, and screed a layer of new bituminous asphalt material over the recycled layer. The repaver vehicle 32 preferably includes a rolling chassis 36, conveyor 37, drive train 38, material hopper 39, fuel supply 40, screeds 41*a,b*, operator station 42, scarifier assembly 44, and heating hood 46 (see FIG. 1).

The rolling chassis 36 preferably includes an elongated frame 48 and multiple wheels 50 rotatably mounted on the frame 48 (see FIG. 1). The rolling chassis 36 is operable to be driven in a forward direction F while forming the new paved road surface.

The drive train 38 includes an internal combustion engine mounted on the chassis 36. The engine receives a flow of fuel from a fuel tank. The drive train 38 also includes a hydrostatic transmission that drivingly interconnects the engine and wheels 50.

In the usual manner, the drive train 38 is operated to power the chassis 36 and move the chassis 36 along the forward direction F. The operator station 42 includes various controls, such as a throttle, steering wheel, transmission lever (all not shown), to operate the engine, the transmission, and the wheels 50 to move the repaver vehicle 32 along the forward direction F and to turn the repaver vehicle 32.

The hopper 39 is preferably located at the front end of the chassis 36 and is configured to receive asphalt material (not shown). The conveyor 37 extends along the length of the chassis 36 from the hopper 39 to a location adjacent to screed 41*b* so that the conveyor 37 can transport new (i.e., hot mix) bituminous asphalt material from the hopper 39 to the screed 41*b*.

The scarifier assembly 44 includes a laterally extending frame 52 and a plurality of teeth 54 mounted to the frame 48. The teeth 54 are spaced laterally along the frame 52 to cooperatively separate an uppermost layer of material from the road R and to break the separated road layer into relatively small pieces of scarified road material.

Again, the repaver vehicle 32 is preferably used to heat the road R and scarify a heated section of road R to separate material from the road R. The repaver vehicle 32 then adds a recycling agent in the form of an emulsified asphalt product to the separated material to form recycled material. The repaver vehicle 32 then preferably screeds recycled material, using screed 41*a*, onto a scarified section of road R to form a recycled layer (not shown). The repaver vehicle 32 also preferably screeds a layer of new hot mix bituminous asphalt material over the recycled layer, using screed 41*b*, to form a finished section of repaved road R.

However, it is within the scope of the present invention where the repaver vehicle 32 has an alternative configuration and/or use. For instance, the vehicle 32 could be used as a remixing vehicle where the vehicle 32 has a single screed 41. In the remixing operation, a new bituminous asphalt material is mixed directly with the recycled road material, and the screed 41 is used to screed the combined mixture and form the new road surface. Similarly, the vehicle 32 could be configured for use as a heater-scarifier vehicle where the vehicle heats the road R, scarifies heated sections of the road R, and adds a recycling agent to the scarified material, but does not screed the recycled material or add new hot mix asphalt to the road R. Yet further, the repaver vehicle 32 could be used to separate the uppermost road layer and remove some or all of the separated layer entirely from the road R without recycling the removed material.

Figure 3:
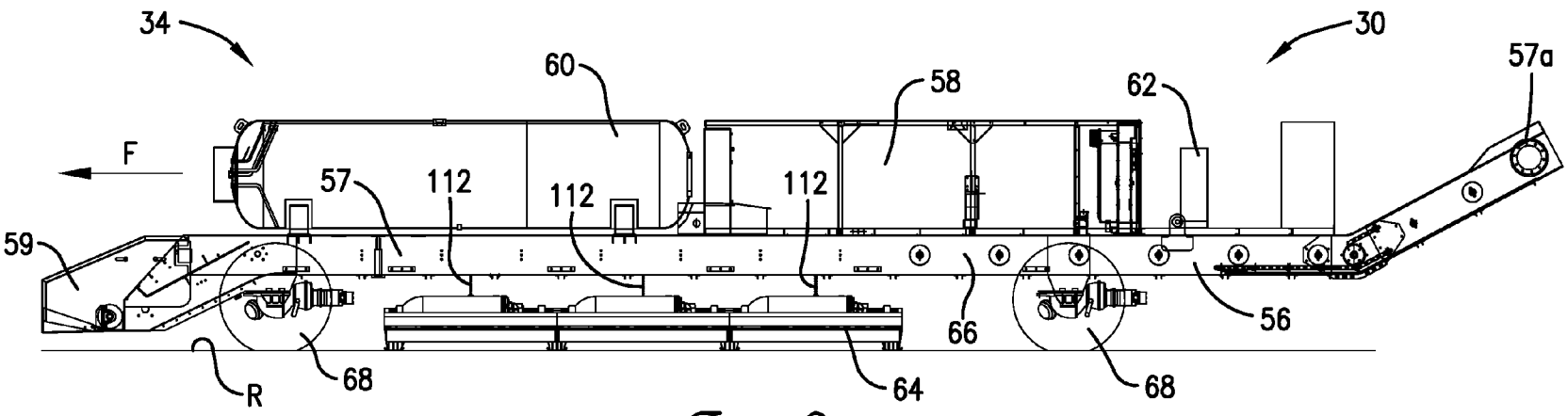
FIG. 3 is a fragmentary side elevation of the repaving system shown in FIG. 1, showing a preheater conveyor vehicle of the repaving system, with the preheater conveyor vehicle including a rolling chassis, a drive train, a fuel supply, an operator station, a receiving hopper, a conveyor system, and a heating hood.
Figure 4:
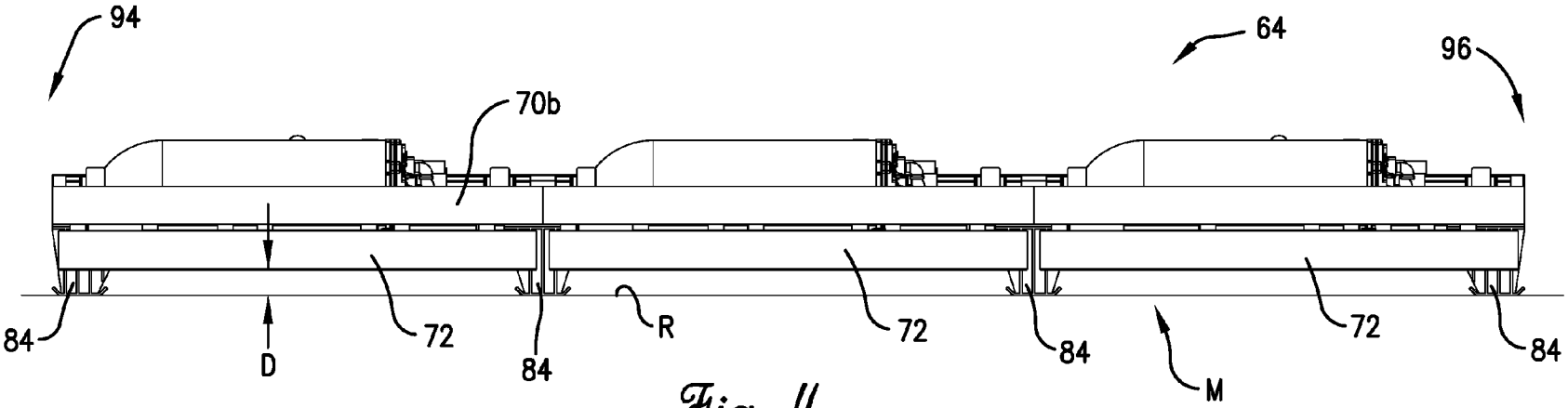
FIG. 4 is an enlarged side elevation of the heating hood shown in FIG. 3, showing a hood frame, plenum enclosures, and burner assemblies of the heating hood.

Turning to FIGS. 3 and 4, the preheater vehicle 34 is preferably used to preheat a section of the road R prior to repaving the section with the repaver vehicle 32. The preheater vehicle 34 preferably includes a rolling chassis 56, conveyor 57, drive train 58, material hopper 59, fuel supply 60, operator station 62, and heating hood 64 (see FIG. 3).

Similar to the chassis 36, the rolling chassis 56 preferably includes an elongated frame 66 and multiple wheels 68 rotatably mounted on the frame 66. The rolling chassis 56 is operable to be driven in the forward direction F while forming the new paved road surface.

The drive train 58 includes an internal combustion engine mounted on the chassis 56. The engine receives a flow of fuel from a fuel tank. The drive train 58 also includes a hydrostatic transmission that drivingly interconnects the engine and wheels 68.

The drive train 58 is operated to power the chassis 56 and move the chassis 56 along the forward direction F. The operator station 62 includes various controls, such as a throttle, steering wheel, transmission lever (all not shown), to operate the engine, the transmission, and the wheels 68 to move the repaver vehicle 34 along the forward direction F and to turn the repaver vehicle 32.

The hopper 59 is preferably located at the front end of the chassis 56 and is configured to receive asphalt material (not shown). The conveyor 57 extends along the length of the chassis 56 from the hopper 59 to a discharge 57*a* of the conveyor 57. Because the illustrated preheater vehicle 34 preferably includes the conveyor 57 and hopper 59, the vehicle 34 is generally referred to as a preheater-conveyor vehicle (PCV). However, the principles of the present invention are applicable where the preheater vehicle 34 is devoid of the conveyor 57 and hopper 59.

Furthermore, while the system 30 preferably includes both vehicles 32,34, the system 30 could be alternatively configured. For instance, the vehicle 34 could be devoid of heating hood 64, such that the vehicle 34 operates as a material transfer vehicle (MTV).

The heating hoods 46,64 of the repaver vehicle 32 and the preheater vehicle 34 are of similar construction and include similar components. For components and features that are generally common to both heating hoods 46,64, such common components and features will be described by reference primarily to the heating hood 46 of the repaver 32.

Each heating hood 46,64 is preferably operable to heat the road R as part of a repaving process. However, the principles of the present invention are applicable where the heating hood is used in an alternative paving application. For instance, the preheater vehicle 34 could be used as part of a standing road paving process where the preheater vehicle 34 is operated in front of a conventional asphalt paving machine to heat the road subsurface prior to applying a new layer of asphalt.

While the heating hoods 46,64 are preferably configured for use with the vehicles 32,34, alternative embodiments of the heating hood 46,64 could be configured for use in an alternative paving vehicle application. For instance, as will be discussed below, one alternative heating hood (not shown) could be used as part of a seam heater device to heat the seam in a road.

Each heating hood 46,64 preferably operates as a hot air heating hood that discharges heated exhaust streams from a lower discharge margin of the hood, with the exhaust streams discharged from the lower margin having no visible flame. Each heating hood 46,64 broadly includes a hood frame 70*a*,*b*, plenum enclosures 72, burner assemblies 74, and a lift mechanism 76.

Turning to FIGS. 5-12, the illustrated hood frame 70 of each heating hood 46,64 includes longitudinal beams 78, transverse beams 80, transverse joists 82, skids 84, and laterally outboard extension sections 86. The hood frame 70 also preferably includes outboard side walls 88, fore and aft end walls 90, and fore and aft end curtains 92.

The hood frame 70 presents fore and aft margins 94,96 of the heating hood 46,64 and defines a longitudinal axis aligned with the forward direction F. The longitudinal beams 78 each comprise a unitary I-beam that extends longitudinally between the fore and aft ends 94,96.

The transverse beams 80 each comprise a unitary I-beam that is spaced between the fore and aft ends 94,96 and interconnects an adjacent pair of longitudinal beams 78. The transverse joists 82 each comprise a unitary channel-shaped beam that is positioned adjacent to one of the fore and aft ends 94,96 and interconnects adjacent ends of the longitudinal beams 78. The hood frame 70 further includes extension lugs 98 fixed to outboard ones of the longitudinal beams 78.

Figure 7:
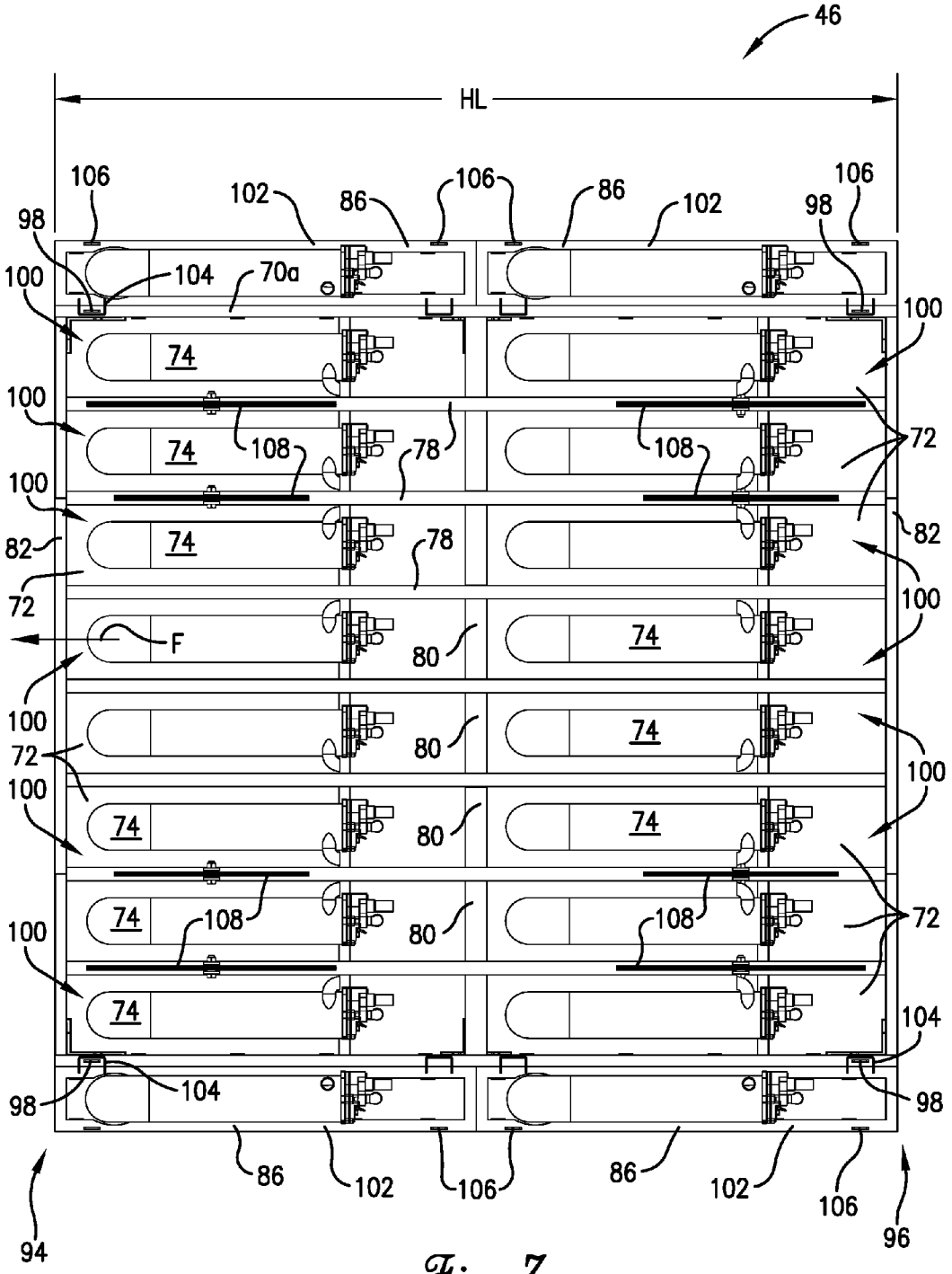
FIG. 7 is a top fragmentary view of the heating hood shown in FIGS. 1, 2, 5, and 6.
Figure 8:
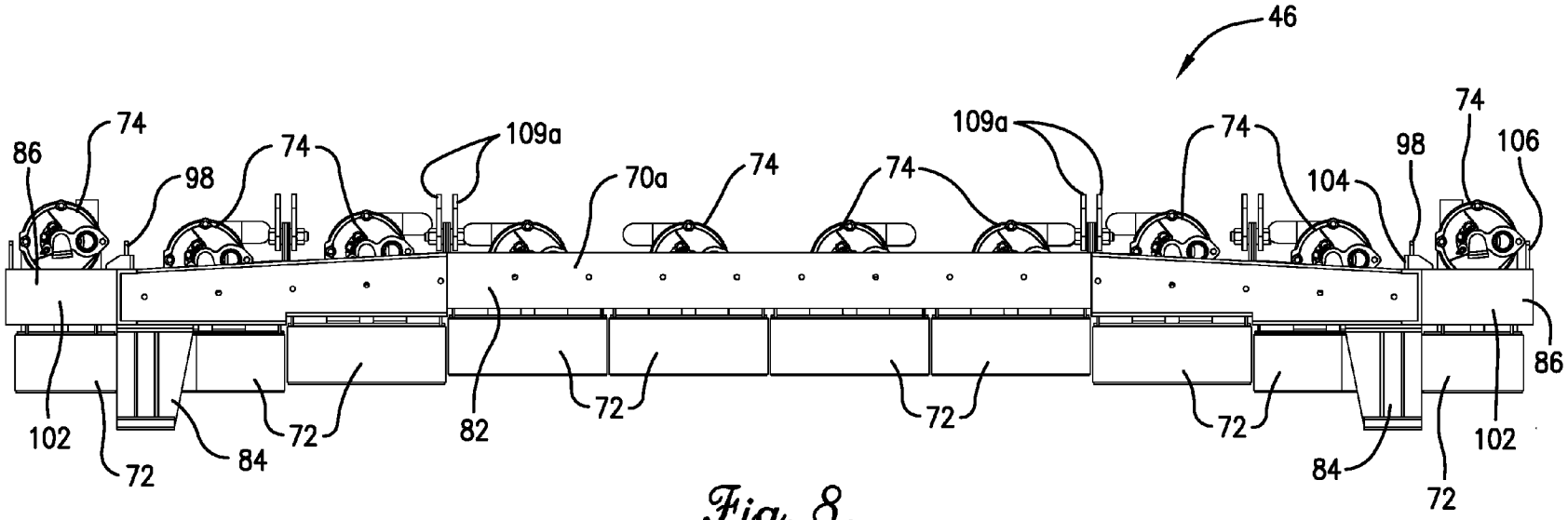
FIG. 8 is a fragmentary rear elevation of the heating hood shown in FIGS. 1, 2, and 5-7.

The beams 78,80 and joists 82 cooperatively form a series of elongated bays 100 to receive the plenum enclosures 72 and burner assemblies 74 (see FIG. 7). The illustrated bays 100 are arranged into two (2) rows, with each row including eight (8) bays 100.

Figure 5:
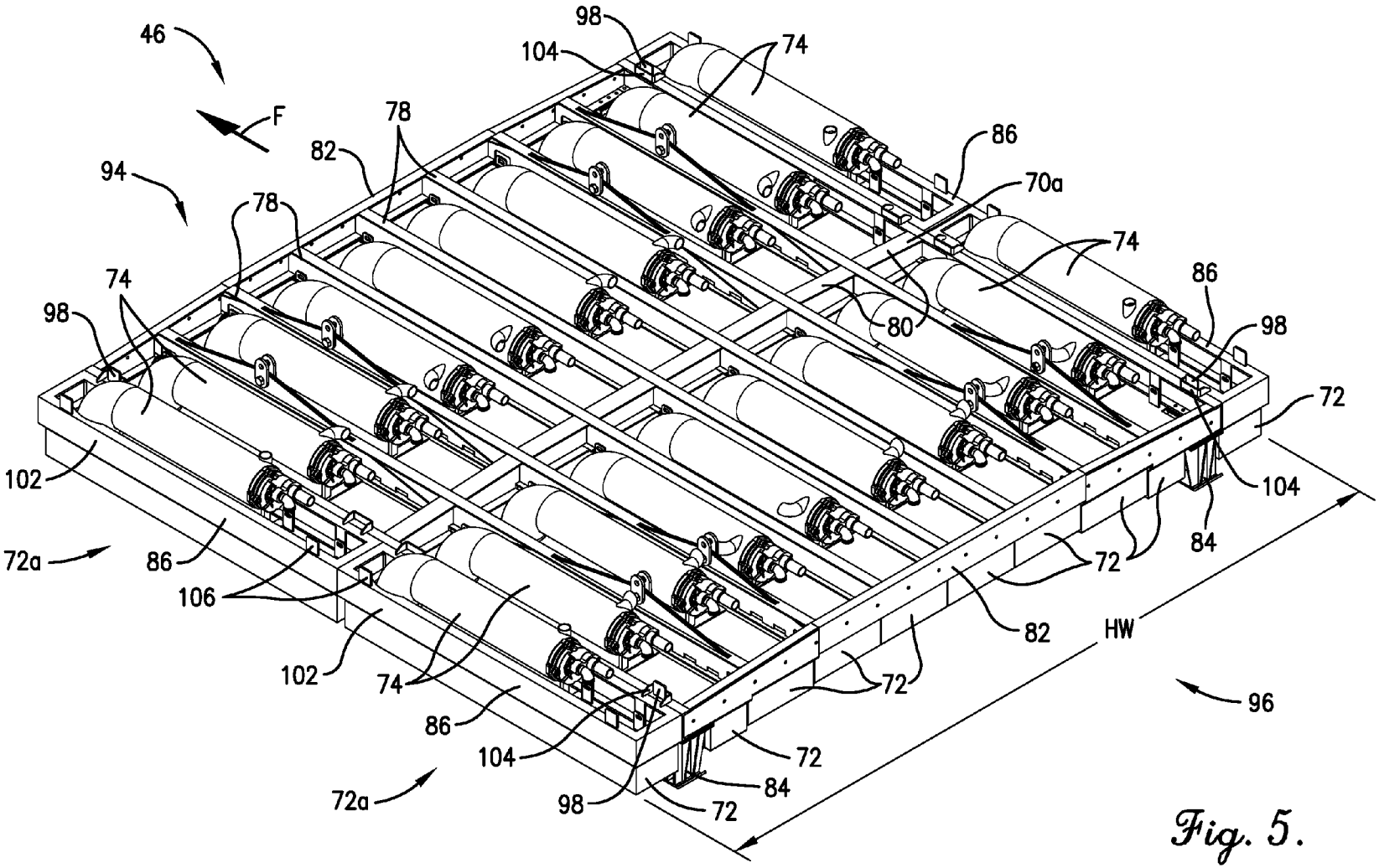
FIG. 5 is an upper fragmentary perspective of the heating hood shown in FIGS. 1 and 2.
Figure 6:
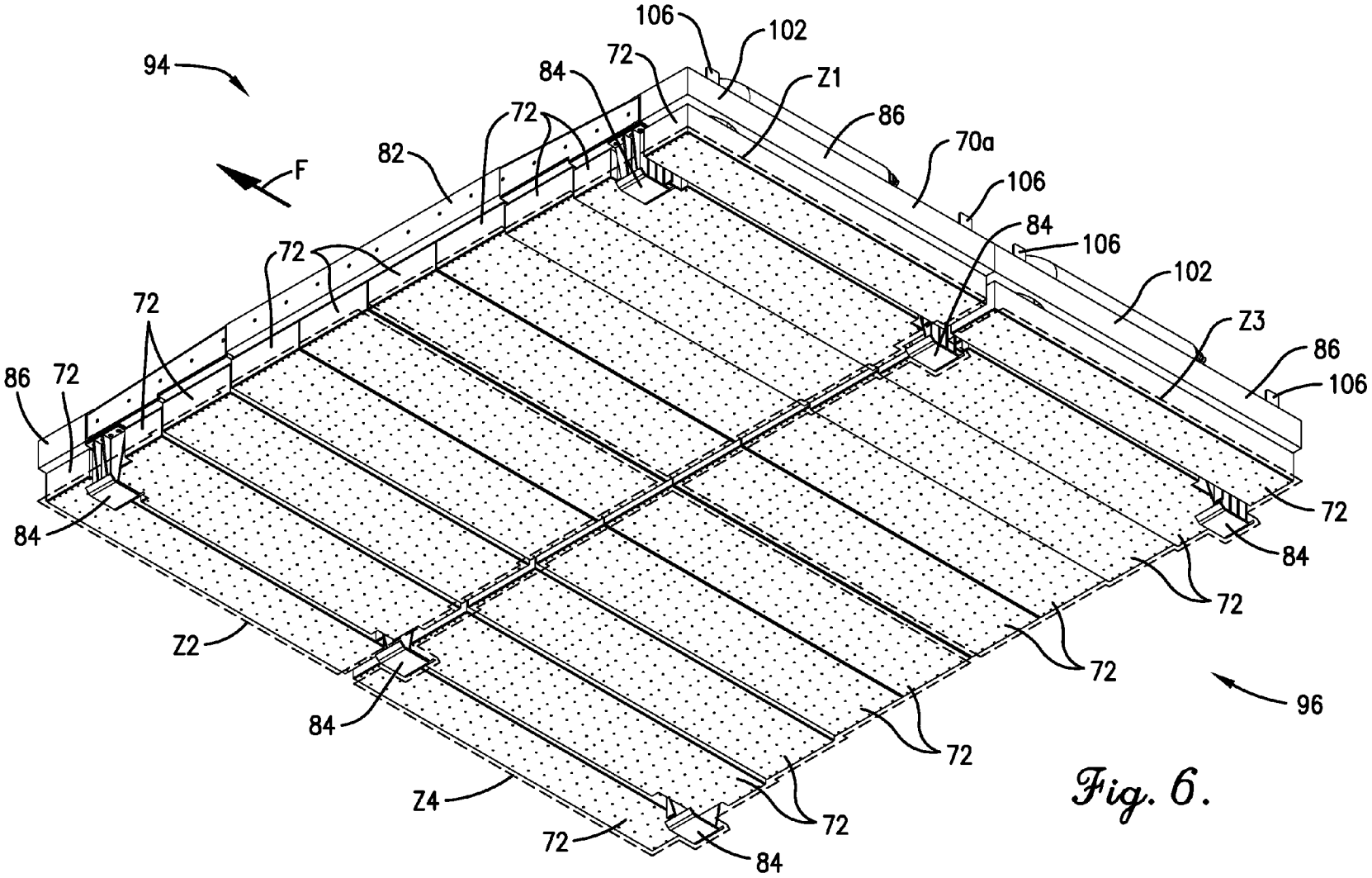
FIG. 6 is a lower fragmentary perspective of the heating hood shown in FIGS. 1, 2, and 5.

Each extension section 86 includes a unitary frame 102, connecting loops 104, and lugs 106 (see FIGS. 5-7). The frame 102 is formed with multiple channel-shaped beams that are welded to one another. The loops 104 and lugs 106 are welded along opposite sides of the frame 102.

The extension sections 86 are removably mounted to opposite sides of the hood frame 70 by inserting lugs 98 into corresponding loops 104. In the illustrated embodiment, the heating hoods 46,64 each include a single column of extension sections 86 on each side of the hood frame 70. However, it is within the ambit of the present invention where at least one side of the hood frame 70 has multiple columns of extension sections 86 attached in series with one another to increase the width of the heating hood 46,64. It will also be appreciated that one or both sides of the hood frame 70 could be devoid of extension sections 86.

Figure 9:
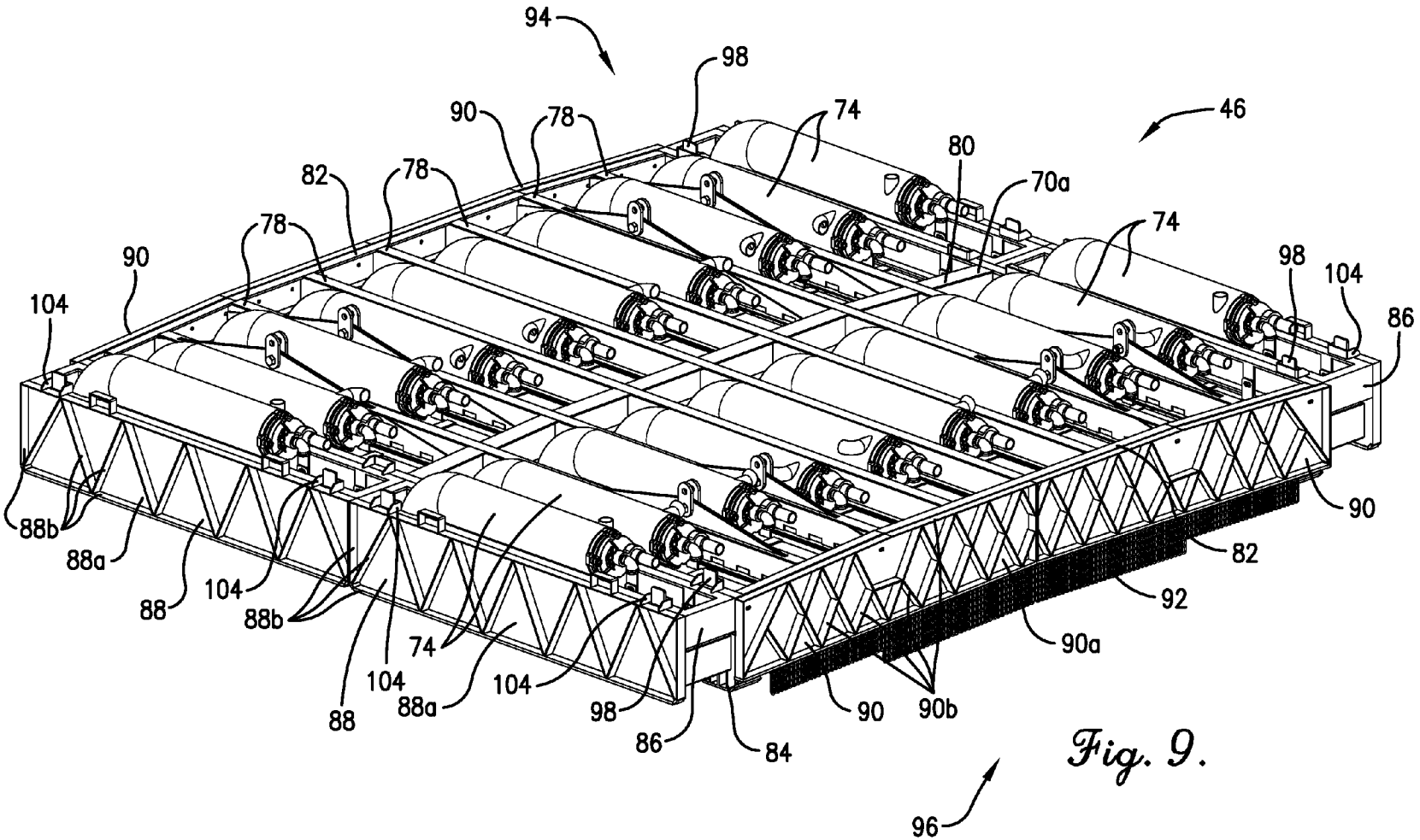
FIG. 9 is an upper perspective of the heating hood shown in FIGS. 1, 2, and 5-8.
Figure 10:
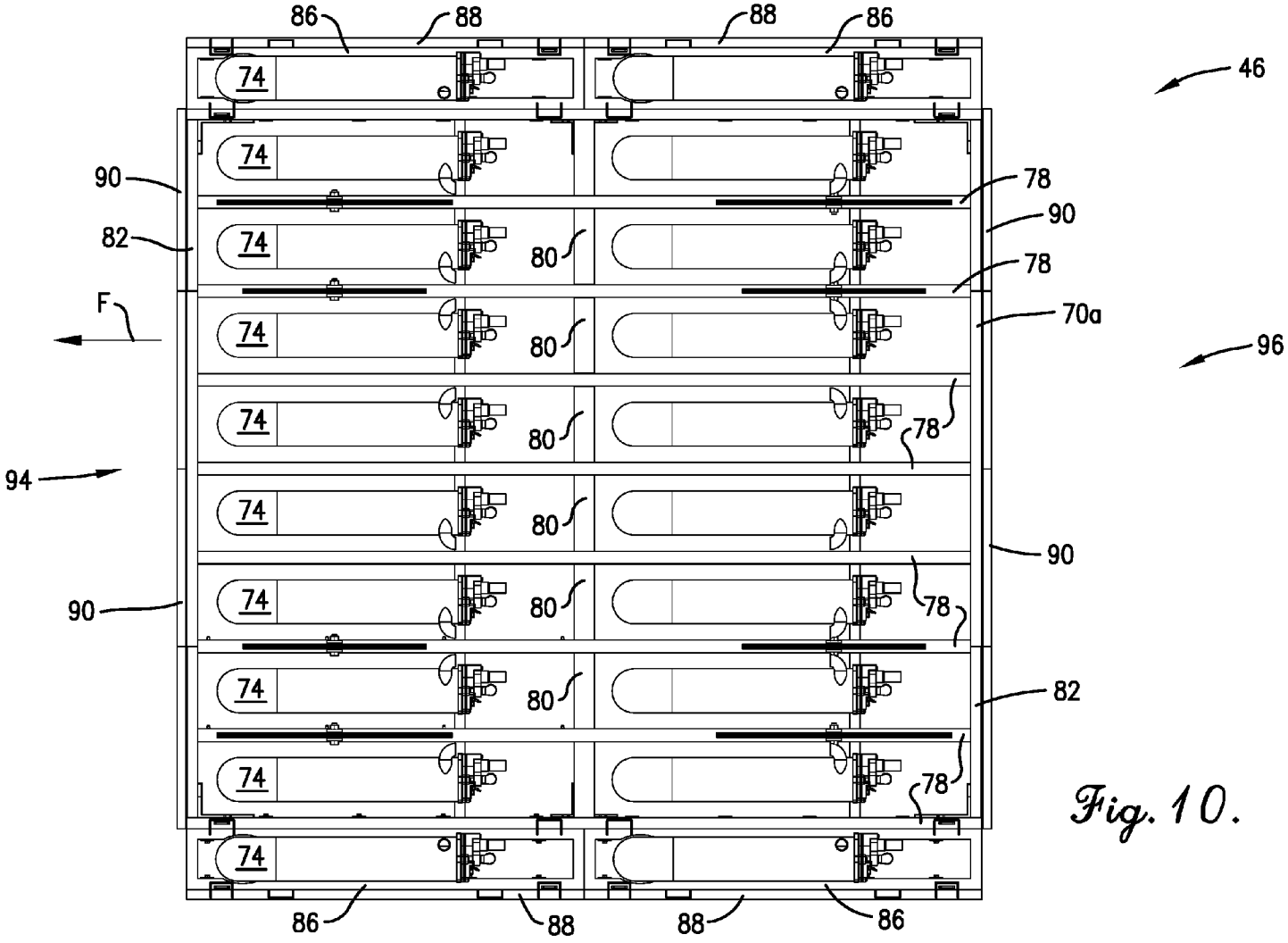
FIG. 10 is a top view of the heating hood shown in FIGS. 1, 2, and 5-9.
Figure 11:
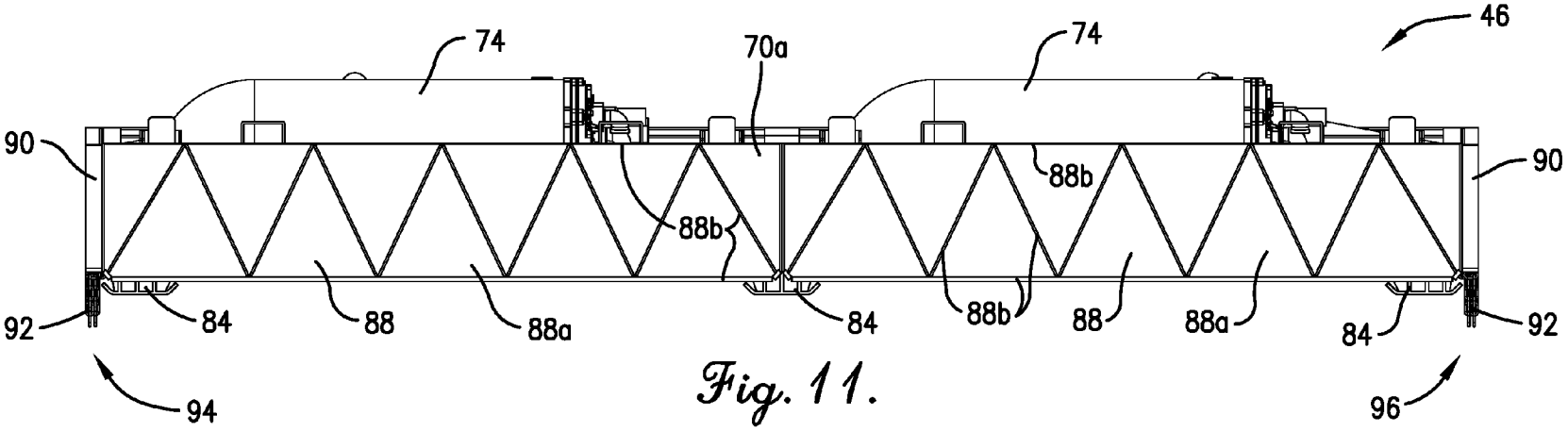
FIG. 11 is a side elevation of the heating hood shown in FIGS. 1, 2, and 5-10.

The outboard side walls 88 preferably include plates 88*a*, reinforcing ribs 88*b*, and loops 104 (see FIGS. 9 and 11). The side walls 88 are removably mounted to opposite sides of the hood frame 70 by inserting lugs 106 of the extension sections 86 into corresponding loops 104 of the side walls 88. When installed, the side walls 88 preferably extend below the extension sections 86 to cover the adjacent enclosures 72.

Figure 12:
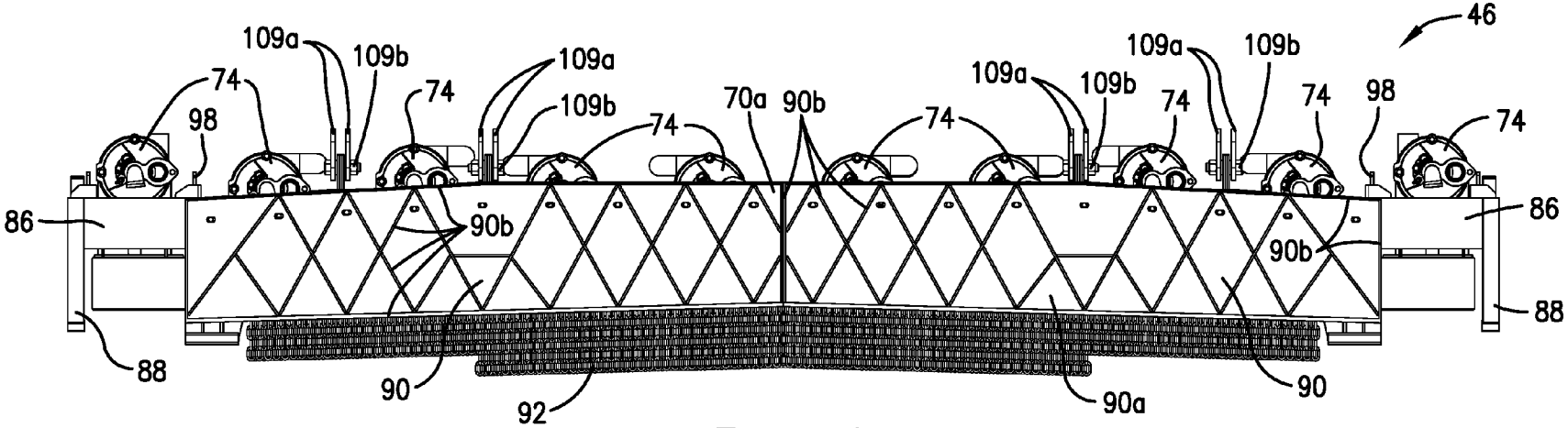
FIG. 12 is a rear elevation of the heating hood shown in FIGS. 1, 2, and 5-11.
Figure 13:
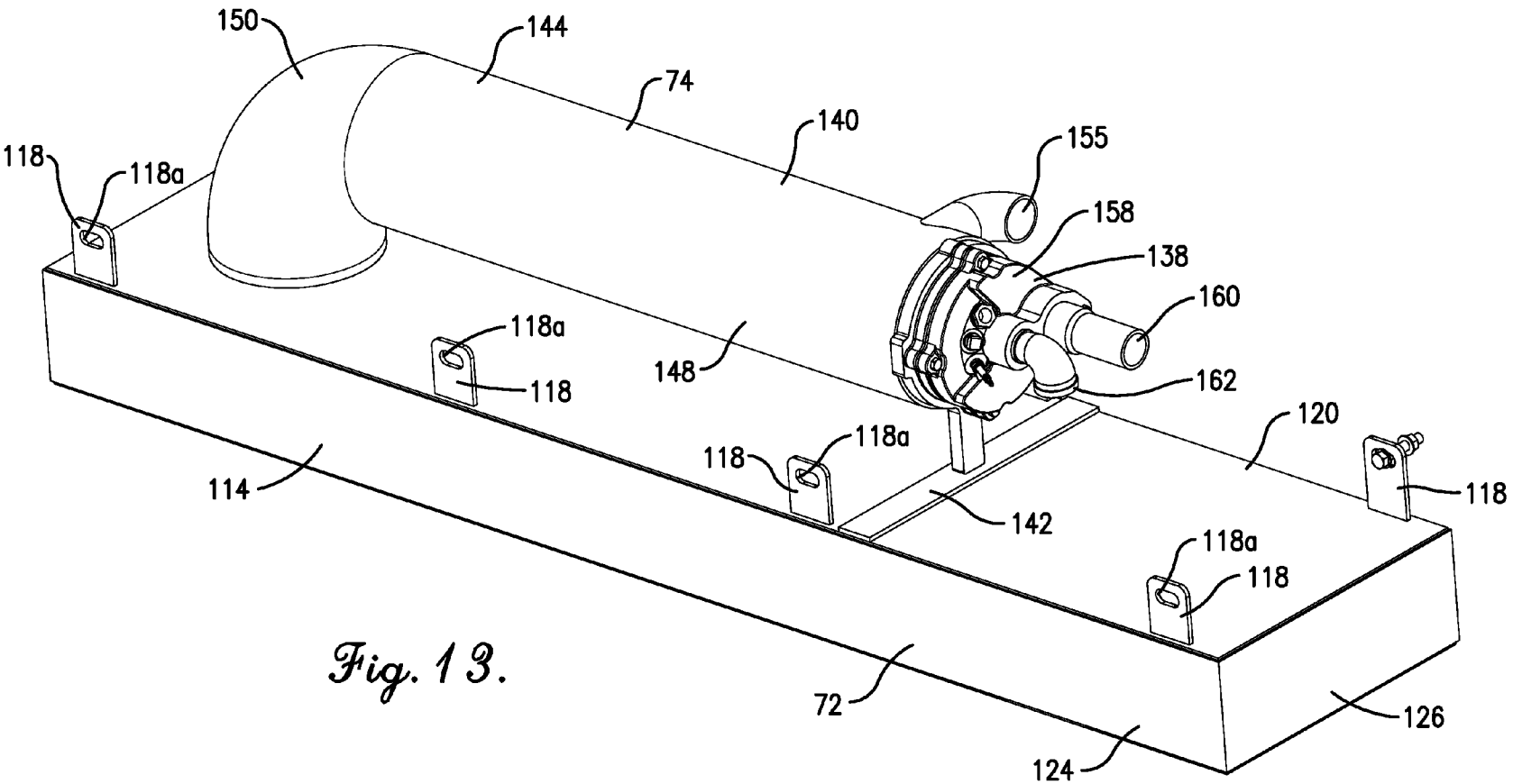
FIG. 13 is an upper fragmentary perspective of the heating hood shown in FIGS. 1, 2, and 5-12, showing one of the enclosures and one of the burner assemblies mounted on the enclosure.

The outboard end walls 90 preferably include plates 90*a* and reinforcing ribs 90*b* (see FIGS. 9 and 12). The end curtains 92 are attached to and hang below the corresponding end walls 90. The end walls 90 are removably mounted to opposite joists 82 along the fore and aft margins 94,96 with fasteners (not shown). When installed, the end walls 90 preferably extend below the joists 82 to cover the adjacent enclosures 72.

Figure 19:
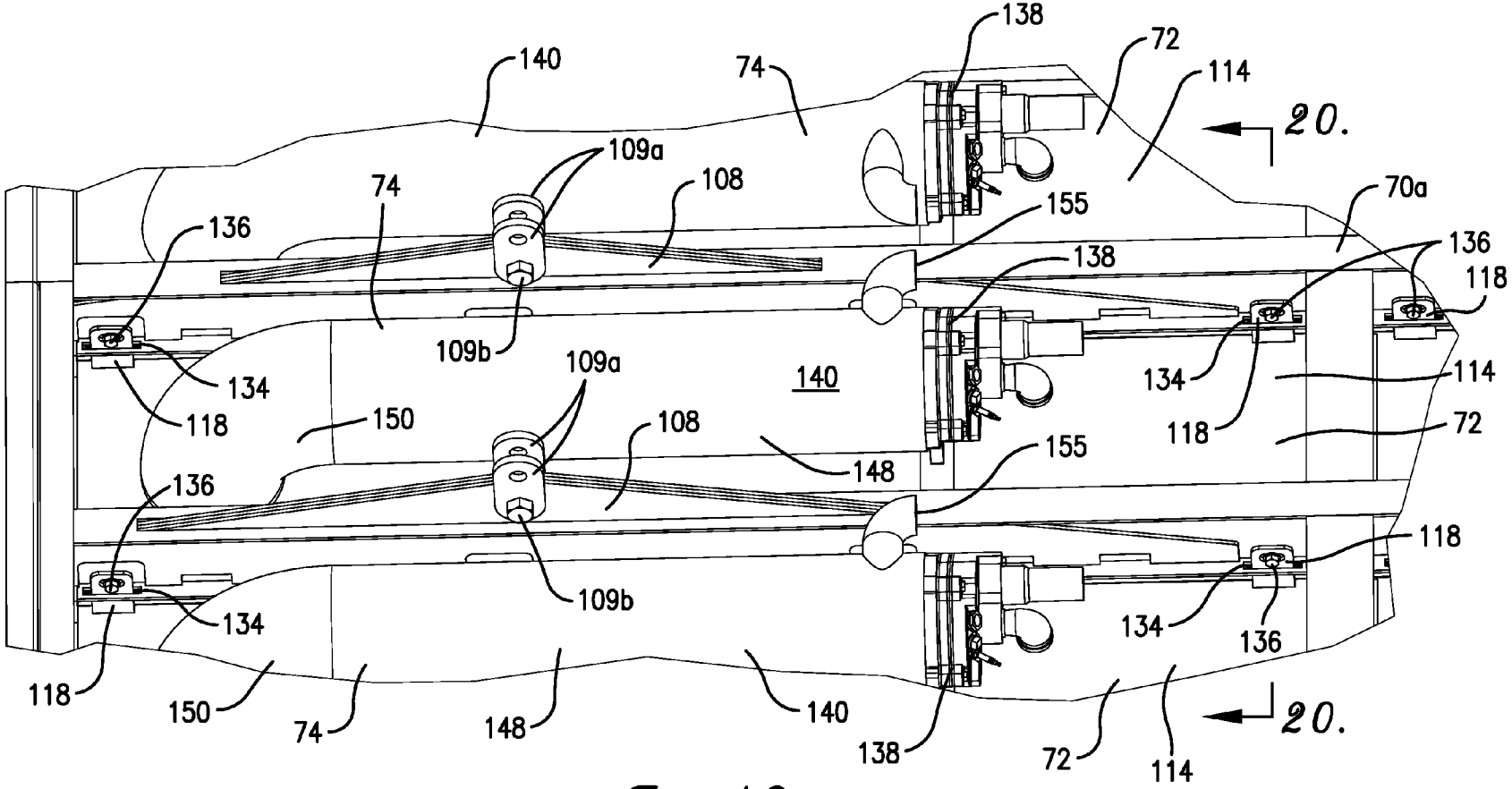
FIG. 19 is a fragmentary perspective of the heating hood shown in FIGS. 1, 2, and 5-13.
Figure 20:
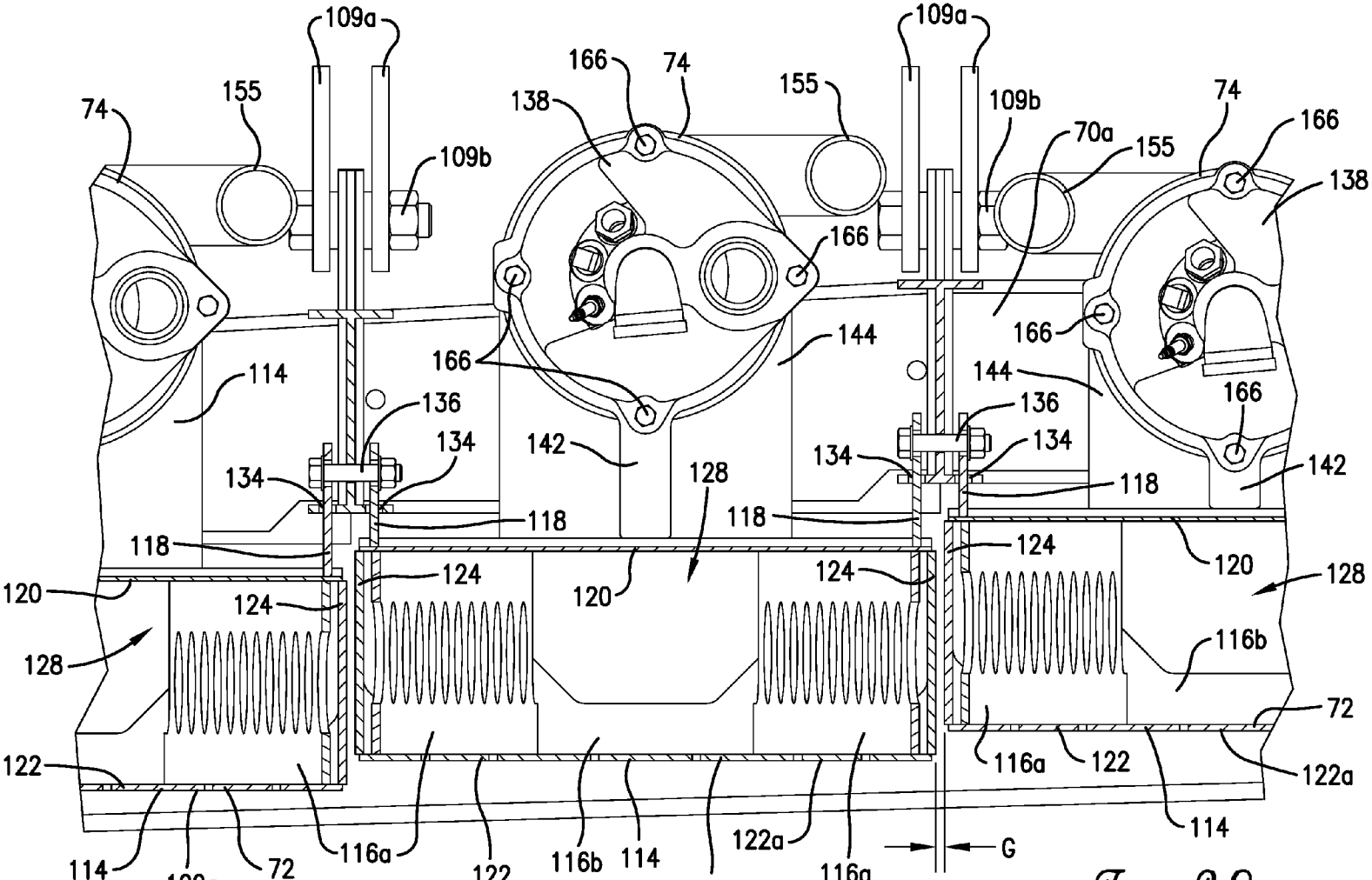
FIG. 20 is a fragmentary cross section of the heating hood taken along line 20-20 in FIG. 19.

The hood frame 70 also preferably includes lifting lugs 108 welded to corresponding ones of the longitudinal beams 78 (see FIGS. 7, 19, and 20). The lugs 108 are removably connected to the lift mechanism 76 with links 109*a* and fasteners 109*b*.

The hood frame 70 is preferably manufactured with stainless steel, although the hood frame 70 could include other materials, such as alloy carbon steel.

The lift mechanism 76 is conventional and includes a pair of hydraulic cylinders 110 and chains 112. The chains 112 are removably attached to corresponding ones of the lifting lugs 108 with links 109*a* and fasteners 109*b* (see FIGS. 12 and 19). The chains 112 are also attached to a piston (not shown) of the corresponding cylinder 110. As the pistons are retracted, the chains 112 are drawn upwardly to cooperatively lift the heating hood 46,64. In a similar manner, as the cylinders 110 are extended, the chains 112 are lowered to cooperatively lower the heating hood 46,64. Prior to operating the vehicles 32,34, the heating hoods 46,64 are preferably lowered by the cylinders 110 into an operating position where the skids 84 are adjacent to and spaced above the road R (see FIGS. 2 and 4). When transporting the vehicles 32,34 to and from a work site, the heating hoods 46,64 are preferably raised by the cylinders 110 (e.g., from the operating position) to a transport position (not shown) where the skids 84 are spaced further above the road R compared to the operating position.

Figure 14:
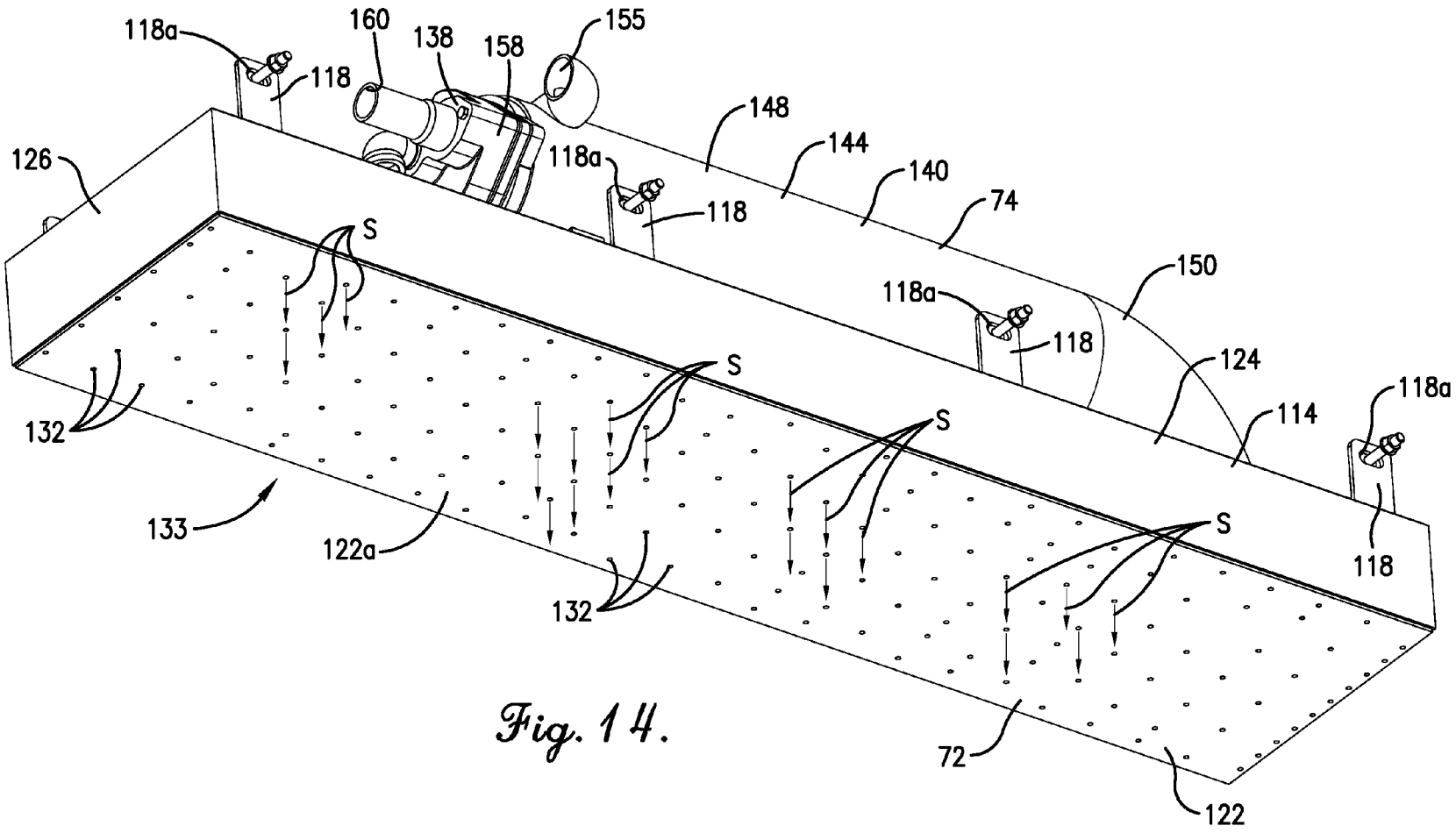
FIG. 14 is a lower perspective of the enclosure and burner assembly shown in FIG. 13.
Figure 15:
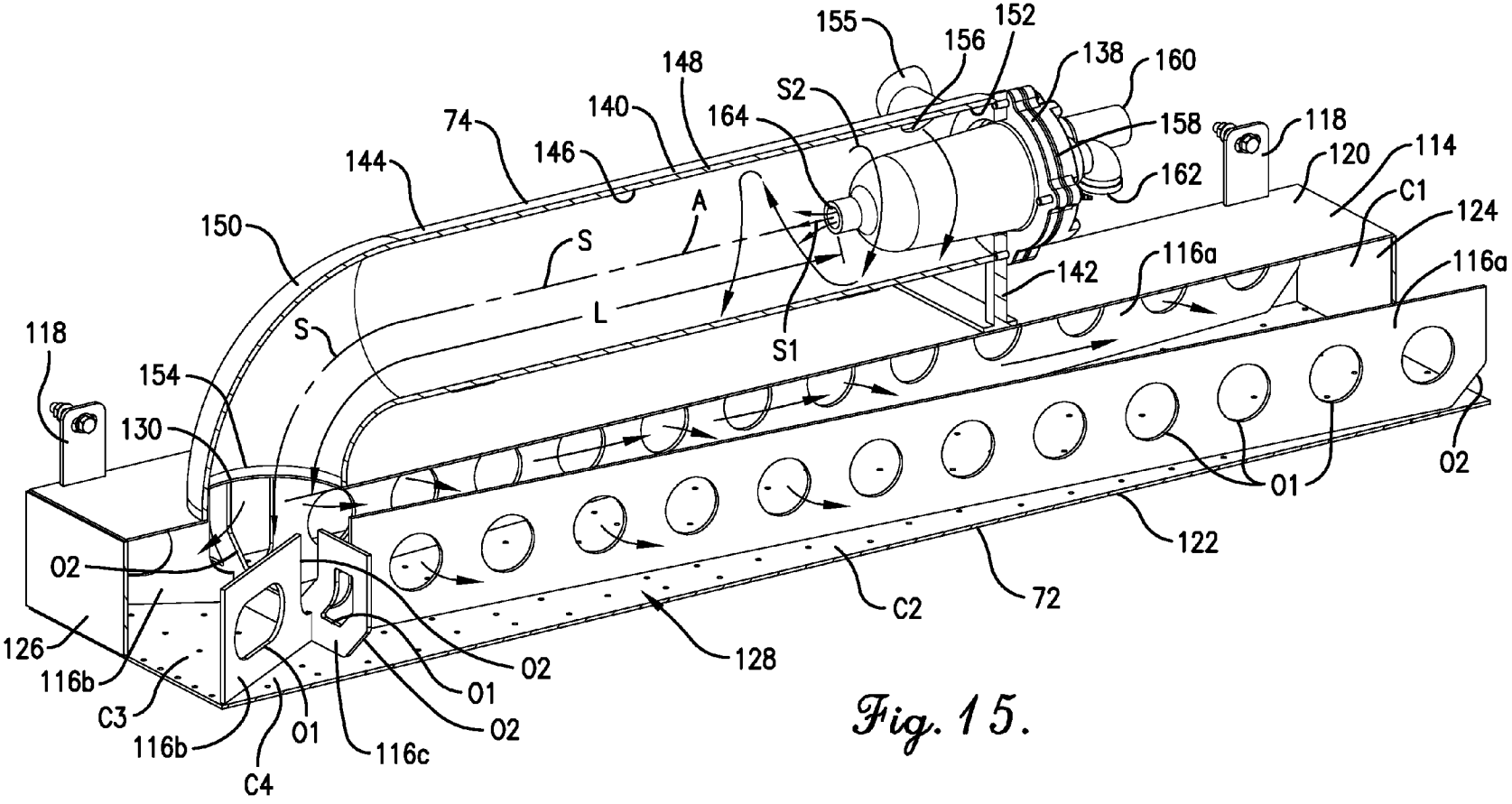
FIG. 15 is a forward fragmentary perspective of the enclosure and burner assembly shown in FIGS. 13 and 14, showing a housing and baffles of the enclosure, and showing a burner mounted partly within an exhaust duct of the burner assembly.
Figure 16:
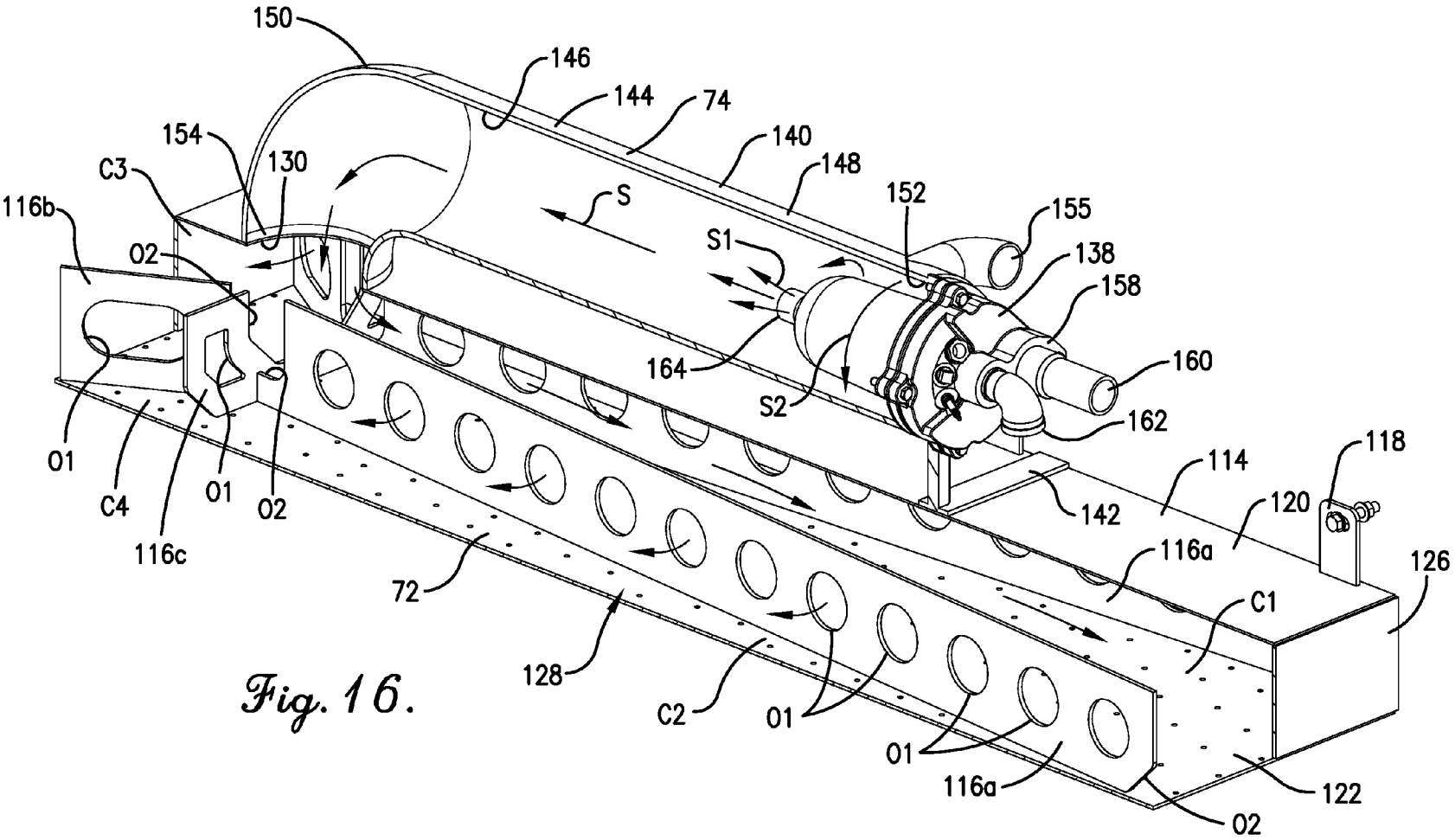
FIG. 16 is a rearward fragmentary perspective of the enclosure and burner assembly shown in FIGS. 13-15, with the exhaust duct including a cold air tube to supply compressed air to the exhaust flue of the duct.

Turning to FIGS. 13-20, the plenum enclosures 72 of the heating hoods 46,64 are each configured to receive and distribute a heated exhaust stream S (see FIGS. 15 and 16). As will be discussed, the enclosure 72 receives the stream S from a corresponding one of the burner assemblies 74. Each enclosure 72 preferably comprises a unitary welded box-type structure that includes an enclosure housing 114, baffles 116*a,b,c* located within and fixed to the housing 114, and support tabs 118 fixed to the housing 114.

The enclosure housing 114 preferably includes top and bottom walls 120,122, side walls 124, and end walls 126 welded together to form a unitary structure. The walls 120,122,124,126 cooperatively define a plenum 128 to receive the heated exhaust stream S (see FIG. 20). The plenum 128 also distributes the stream S laterally along the road R.

Figure 17:
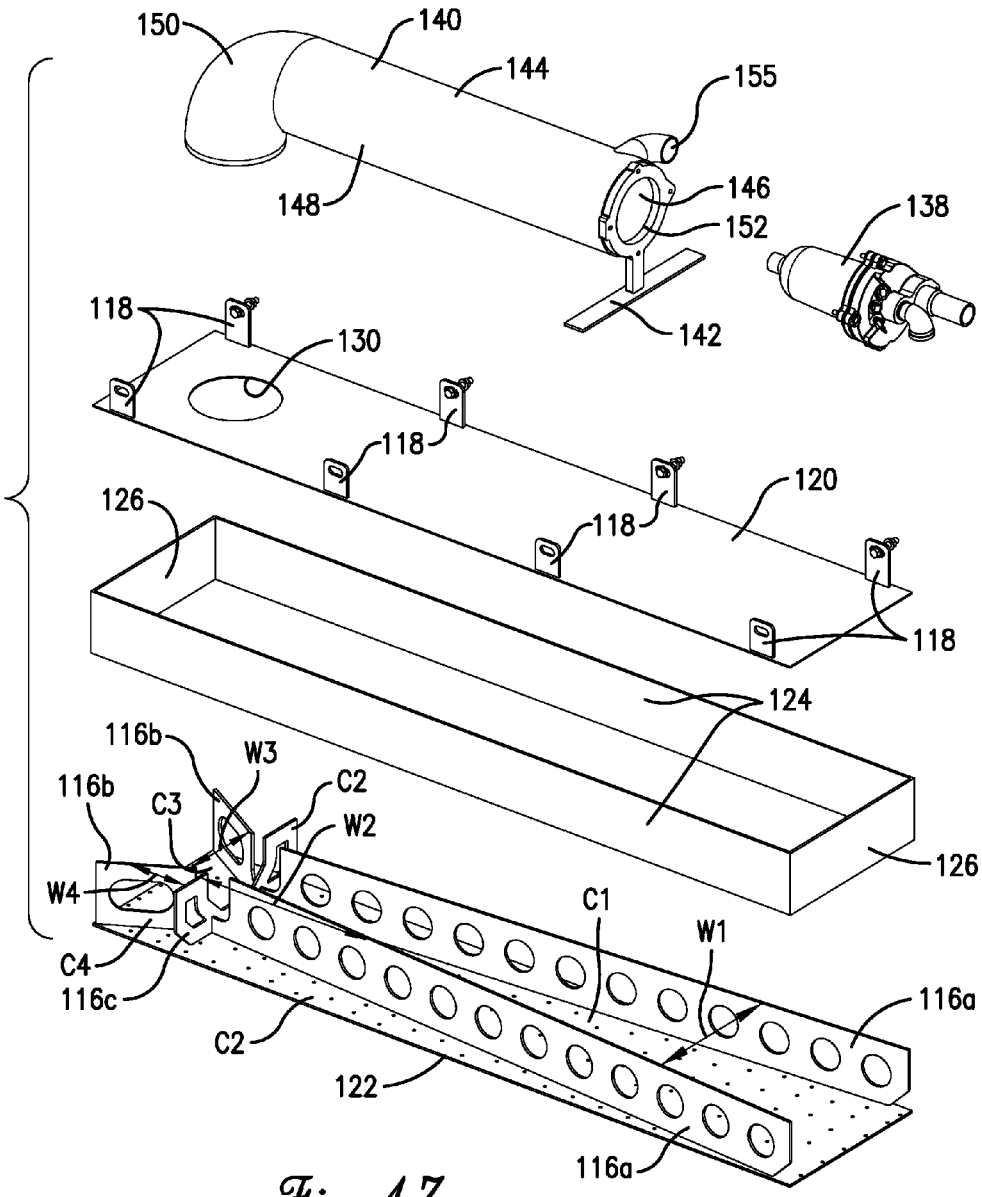
FIG. 17 is an upper exploded perspective of the enclosure and burner assembly shown in FIGS. 13-16.
Figure 18:
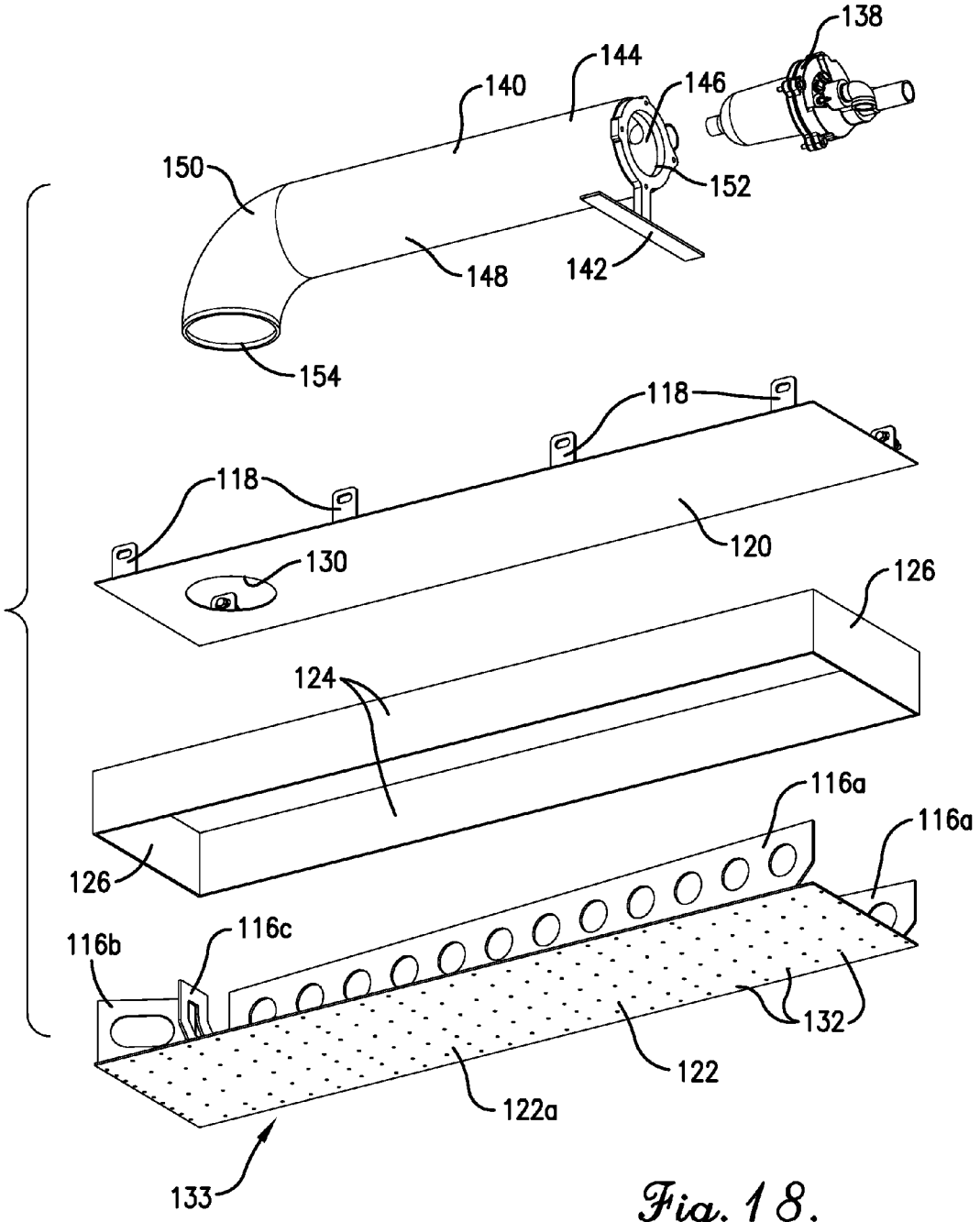
FIG. 18 is a lower exploded perspective of the enclosure and burner assembly shown in FIGS. 13-17.

The top wall 120 preferably presents a plenum inlet opening 130 (see FIGS. 17 and 18). The inlet opening 130 fluidly communicates with the plenum 128 to permit the heated exhaust stream S to flow into the plenum 128 from the burner of the burner assembly 74. However, it is within the ambit of the present invention where the inlet opening 130 is alternatively provided (e.g., where one of the side walls 124 or end walls 126 presents the inlet opening 130).

The bottom wall 122 preferably presents an exposed surface 122*a* that is perforated (see FIG. 14). In particular, the bottom wall 122 preferably defines a plurality of perforations 132 having a generally circular shape and being arranged in a pattern along the surface 122*a*. The perforations 132 are spaced apart from one another and cooperatively provide an enclosure outlet 133 of the enclosure housing 114. The perforations 132 of the outlet 133 fluidly communicate with the plenum 128 to discharge the heated exhaust stream S from the plenum 128. The configuration of the bottom wall 122 serves to discharge the heated exhaust stream S through the outlet 133 by dispersing the stream S generally uniformly along the area of the surface 122*a* (see FIG. 14).

However, it is within the ambit of the present invention where the outlet 133 of the bottom wall 122 is alternatively configured to discharge the stream S. For instance, the perforations 132 could have an alternative size, where each perforation is circular and has a larger or smaller diameter dimension. Similarly, the perforations 132 could have an alternative geometric shape (e.g., where each perforation 132 is an elongated slot, such as elliptical or rectangular slot).

It will also be appreciated that the bottom wall 122 could have an alternative number of perforations 132. While the bottom wall 122 preferably forms the outlet 133, each enclosure 72 could be alternatively configured to present the outlet 133. For instance, the enclosure 72 could have an alternative structure to present perforations 132 or another opening configuration suitable for discharging the stream S. Furthermore, the enclosure 72 could be devoid of bottom wall 122. For instance, the enclosure housing 114 could have an open bottom, with the baffles 116 being configured to uniformly discharge the stream S along the enclosure housing 114.

The baffles 116*a,b,c* extend laterally within the plenum 128 to direct the stream S within the plenum 128. In particular, each of the baffles 116 preferably extends from a location adjacent the inlet opening 130 in a laterally outward direction away from the inlet opening 130. Furthermore, each pair of adjacent baffles 116 preferably diverge from each other.

Each baffle 116 preferably comprises a unitary plate that presents corresponding openings O1,O2 to permit diffusion of the stream S (see FIGS. 15 and 16). Specifically, the baffles 116*a* include a series of openings O1 that are spaced within the margins of the plate and endmost openings O2 that define end margins of the plate. Baffles 116*b* each include an opening O1 spaced within the margins of the plate and an endmost opening O2 that defines one end margin of the plate. Baffle 116*c* includes a pair of openings O1 that are spaced within the margins of the plate, a pair of endmost openings O2 that partly define end margins of the plate, and a centrally located opening O2 that defines a central U-shaped margin of the plate. The openings O2 adjacent the inlet opening are preferably shaped to permit the stream S to enter the plenum 128 with minimal flow resistance.

The illustrated arrangement of baffles 116 cooperates with the walls 120,122,124,126 to form chambers C1,C2,C3,C4 (see FIGS. 15-17). Each chamber C1,C2,C3,C4 preferably extends from a location adjacent the inlet opening 130 in the laterally outward direction away from the inlet opening 130. Each pair of adjacent baffles 116 cooperatively define a width dimension W1,W2,W3,W4 of the corresponding chamber C1,C2,C3,C4 (see FIG. 17). Because each pair of adjacent baffles 116 preferably diverge from each other, the width dimensions W1,W2,W3,W4 each preferably increase in the laterally outward direction.

While the illustrated arrangement of baffles 116 is preferred, the enclosure 72 could have an alternative baffle configuration. For instance, the baffles 116*a* could be spaced apart but extend parallel to one another. Also, the enclosure 72 could have an alternative number of baffles 116. For some aspects of the present invention, the enclosure 72 could be devoid of baffles 116.

The walls 120,122,124,126 and baffles 116 each preferably include a continuous metal plate made from a stainless steel material. However, it is within the scope of the present invention where any of the walls 120,122,124,126 and baffles 116 includes an alternative metal material.

The support tabs 118 each preferably comprise an elongated strip of material that is fixed to the enclosure housing 114. Each tab 118 presents slots 118*a* that are spaced above the enclosure housing 114 (see FIGS. 13 and 14). However, it is within the scope of the present invention where the tabs 118 are alternatively configured.

The enclosures 72 are each preferably positioned within a corresponding one of the bays 100 to extend laterally along the road R (see FIGS. 1-4). More preferably, in the illustrated embodiment, the enclosures 72 are each positioned so that the longitudinal axis of the enclosure 72 extends laterally along the forward direction F. However, it is within the ambit of the present invention where the enclosures 72 are alternatively oriented relative to the forward direction F. The enclosures 72 cooperatively form a lower margin M of each heating hood 46,64 (see FIGS. 2 and 4).

The lower margin M of the illustrated heating hoods 46,64 preferably includes the disclosed lower outlets 133. However, the principles of the present invention are applicable where the lower margin M includes an alternative number and/or arrangement of lower outlets 133. For some aspects of the present invention, the heating hoods 46,64 could include a single continuous lower outlet 133 provided by a single enclosure 72.

Figure 21:
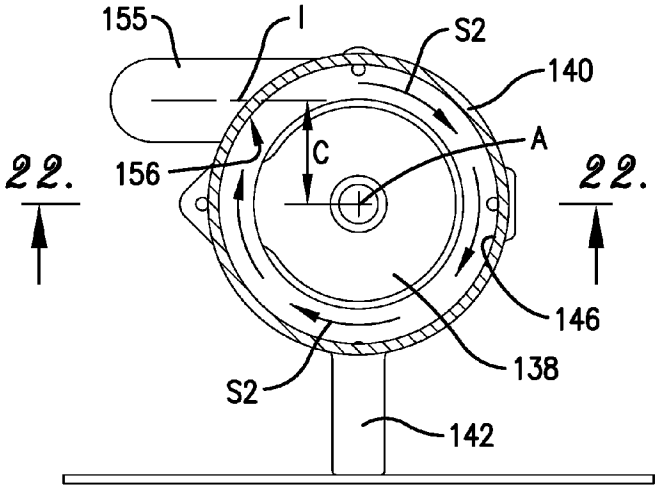
FIG. 21 is a fragmentary cross section of the burner assembly shown in FIGS. 13-18, showing the flow of compressed air from the cold air inlet into the exhaust flue and the swirling direction of compressed air flow as the flow advances along the exhaust flue.

The illustrated enclosures 72 are also preferably mounted alongside one another to form multiple rows 72*a* of enclosures 72 that extend transversely to the forward direction F (see FIGS. 5 and 21). Within each row 72*a*, the enclosures 72 are positioned in series with one another and spaced apart so that each adjacent pair of enclosures 72 defines a lateral gap G (see FIG. 20). The gap G permits relative movement between the adjacent pair of enclosures 72 (e.g., movement due to thermal expansion and/or contraction of the heating hood 46,64). At the same time, the gap G is preferably sized to restrict the streams S from escaping upwardly between the enclosures 72. The gap G preferably ranges between about zero inches (0") and about one inch (1"). While the enclosures 72 are preferably spaced apart to form a continuous gap therebetween, the heating hoods 46,64 could be alternatively constructed. For instance, the heating hoods 46,64 could include a seal-type element or device between adjacent enclosures 72 to permit movement of the enclosures 72 while restricting the streams S from escaping upwardly between the enclosures 72.

The repaver vehicle 32 preferably includes two (2) rows 72*a*, with each row 72*a* having ten (10) enclosures 72. The preheater vehicle 34 preferably includes three (3) rows 72*a*, with each row 72*a* having ten (10) enclosures 72. However, the principles of the present invention are applicable where at least one of the vehicles 32 has an alternative number of rows 72*a* and/or an alternative number of enclosures 72 within each row 72*a*.

As mentioned previously, one alternative heating hood could be used as part of a seam heater device to heat the seam in a road. In this embodiment, the alternative heating hood preferably includes a single column of four (4) to six (6) enclosures 72 positioned in series along the length of the hood. The seam heater is preferably a vehicle that is towed in front of an asphalt paving machine. However, the seam heater could comprise a self-propelled vehicle.

The tabs 118 are attached to the hood frame 70 to permit the enclosures 72 to move vertically relative to the hood frame 70. In the illustrated embodiment, the hood frame 70 presents slots 134 that slidably receive tabs 118 (see FIGS. 19 and 20). The tabs 118 are slidably secured to the hood frame 70 with fasteners 136 (see FIGS. 19 and 20). As a result, the enclosures 72 are preferably permitted to move vertically relative to the hood frame 70.

In the illustrated embodiment, adjacent pairs of enclosures 72 are preferably connected to one another with fasteners 136 (see FIG. 20). Because of this connection, each pair of connected enclosures 72 generally move with one another in the vertical direction, at least in the region near the connection. It will be appreciated that the connection permits one (or both) of a pair of connected enclosures 72 to pivot about a longitudinal axis of the enclosure 72. Such pivotal movement may or may not occur as the connection between the enclosures 72 moves up or down.

It has been found that the illustrated connection arrangement between pairs of connected enclosures 72 enables the enclosures 72 to thermally expand and contract while minimizing the possibility of damage to the enclosures 72 due to such thermal expansion and contraction. At the same time, the illustrated connection arrangement serves to position the surfaces 122*a* of the enclosures 72 above the curved surface of the road R to define a spacing dimension D that is generally consistent among the enclosures 72 (see FIGS. 2 and 4). In the illustrated embodiment, the spacing dimension D preferably ranges from about four inches (4") to about eighteen inches (18").

The heating hoods 46,64 of the illustrated embodiment preferably include a plurality of discrete enclosures 72 that provide the lower margin M of each hood 46,64 and the lower outlets 133. However, for some aspects of the present invention, the heating hoods 46,64 could be alternatively configured (e.g., where one of the heating hoods 46,64 includes a single continuous enclosure 72 that presents one or more lower outlets 133).

Figure 23:
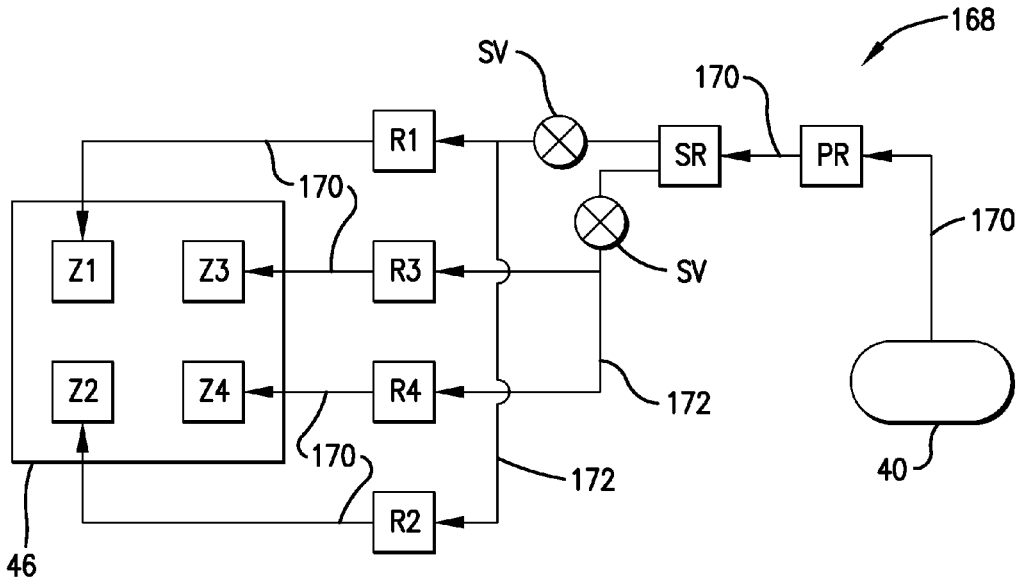
FIG. 23 is a fragmentary schematic view of the heating hood shown in FIGS. 1 and 2, showing a fuel system of the heating hood.
Figure 24:
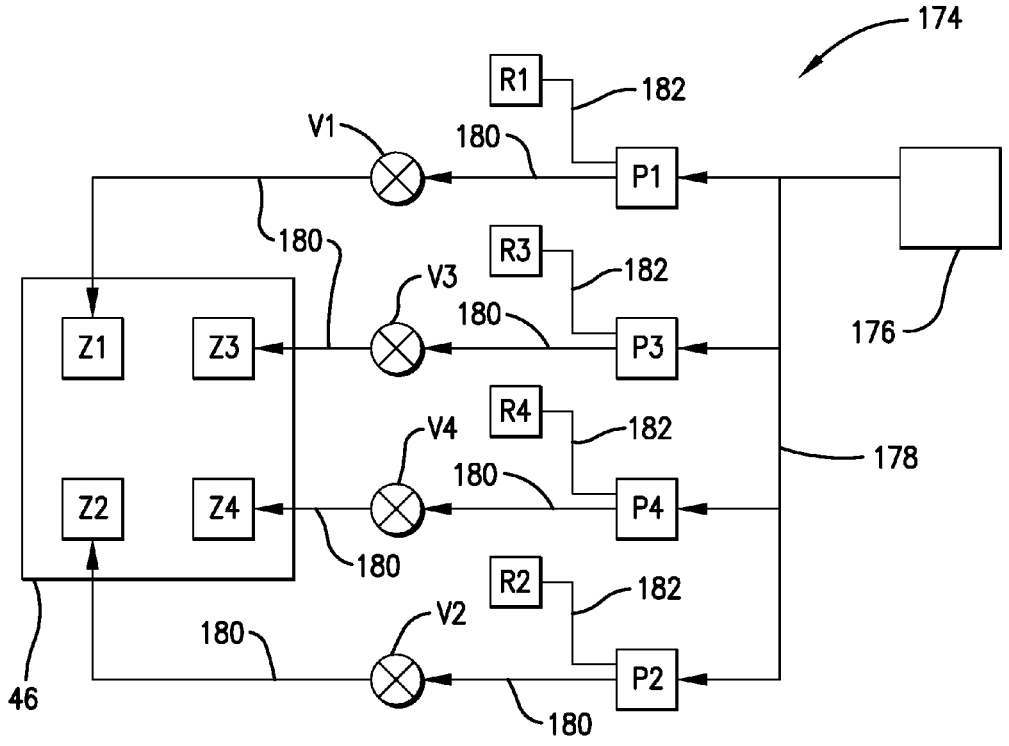
FIG. 24 is a fragmentary schematic view of the heating hood shown in FIGS. 1 and 2, showing a compressed air system of the heating hood.
Figure 25:
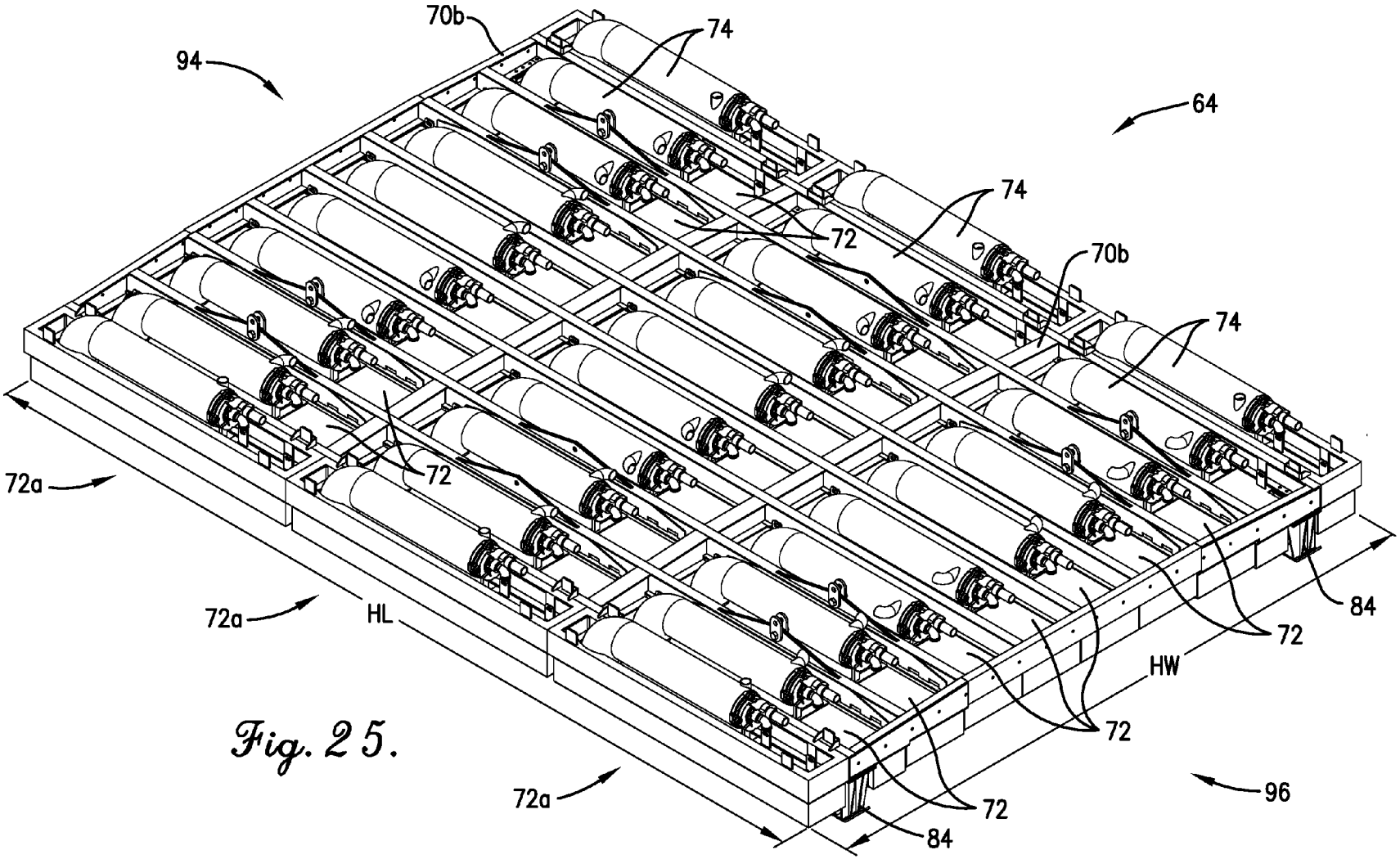
FIG. 25 is an upper fragmentary perspective of the heating hood shown in FIGS. 3 and 4.
Figure 26:
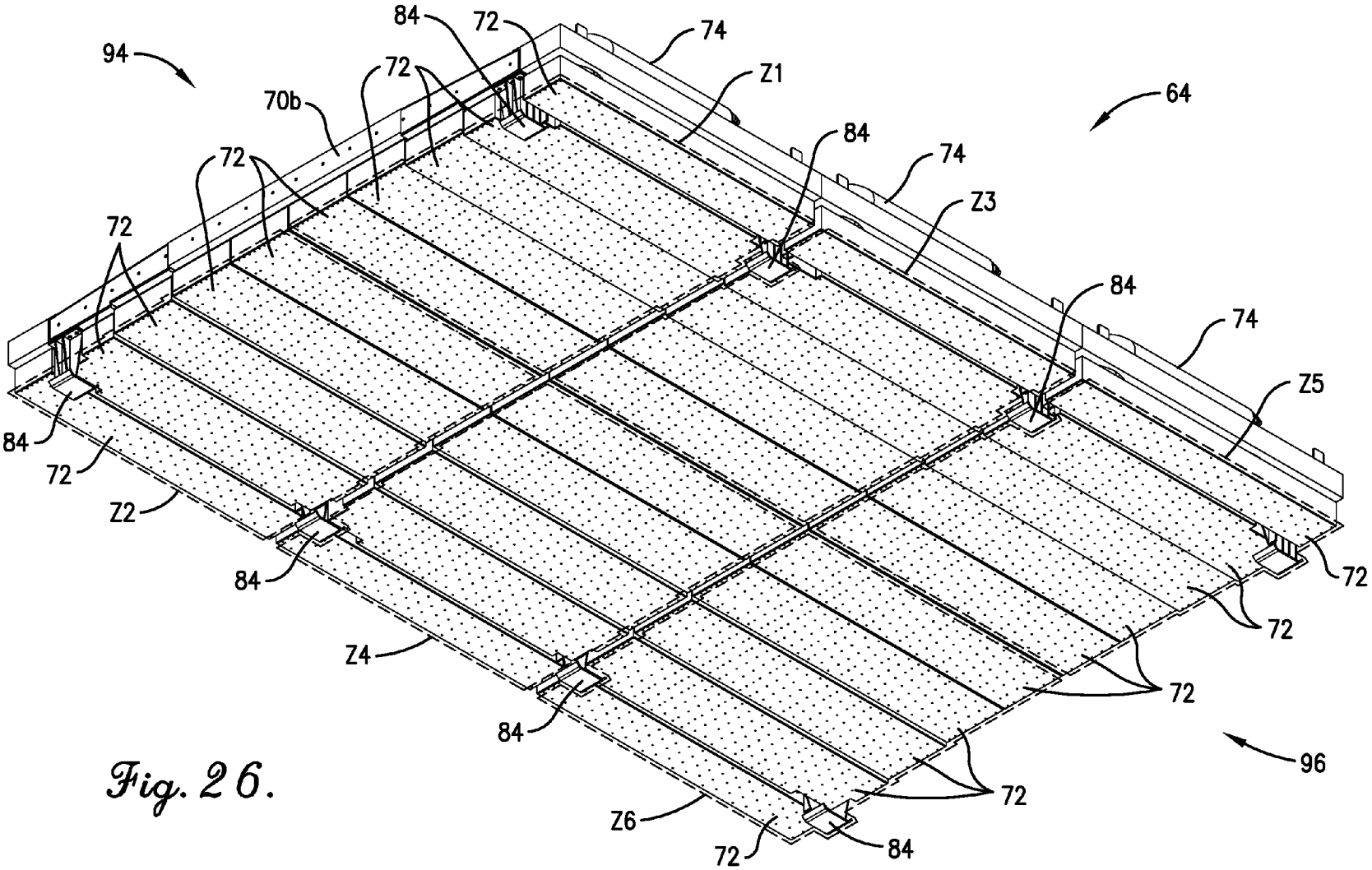
FIG. 26 is a lower fragmentary perspective of the heating hood shown in FIGS. 3, 4, and 25.

The heating hood 46 preferably includes multiple, independently controllable, heating zones Z1-Z4 (see FIGS. 6, 23, and 24). Each heating zone Z1-Z4 preferably includes a corresponding series of plenum enclosures 72 and the associated burner assemblies 74 (see FIG. 6). As will be described, each zone Z1-Z4 receives a corresponding flow of fuel and a corresponding flow of compressed air that is distributed to the respective burner assemblies 74. In this manner, each zone Z1-Z4 is preferably operable independently of the other zones. Similarly, the heating hood 64 preferably includes heating zones Z1-Z6 (see FIG. 26) that each receive corresponding flows of fuel and compressed air so that each zone Z1-Z6 is operable independently of the other zones.

The illustrated heating hoods 46,64 present a hood width dimension HW that preferably ranges from about eight feet (8') to about twenty feet (20') and, more preferably, is about eleven feet (11') (see FIGS. 5 and 23). The illustrated heating hood 46 presents a hood length dimension HL that preferably ranges from about ten feet (10') to about twenty feet (20') and, more preferably, is about thirteen feet (13') (see FIG. 7). The heating hood 64 presents a hood length dimension HL that preferably ranges from about thirteen feet (13') to about fifty-two feet (52') and, more preferably, is about nineteen (19') (see FIG. 21). However, an alternative heating hood could have alternative length and/or width dimensions. For instance, the alternative hood for use with a seam heater presents a hood width HW that preferably ranges from about ten inches (10") to about eighteen inches (18"). The alternative hood also presents a hood length HL that preferably ranges from about ten feet (10 ft) to about thirty feet (30 ft).

Referring to FIGS. 13-22, the heating hoods 46,64 each include burner assemblies 74. Each burner assembly 72 supplies a corresponding heated exhaust stream S to a corresponding one of the plenum enclosures 72. The burner assembly 74 preferably includes a burner 138 and an exhaust duct 140.

The exhaust duct 140 is preferably used to transport the stream S from the burner 138 to the corresponding one of the plenum enclosures 72. As will be described, the stream S includes a mixture of a burner stream S1 and a compressed air stream S2. Preferably, the exhaust duct 140 includes a mounting bracket 142 and a unitary tube 144 that defines a continuous exhaust flue 146 (see FIGS. 15 and 16). The illustrated tube 144 is unitary and preferably includes a generally linear section 148 and a curved section 150. The tube 144 also preferably presents a burner mounting opening 152 and a duct outlet 154.

The illustrated tube 144 defines a flue diameter dimension T (see FIG. 22) that preferably ranges from about four inches (4") to about sixteen inches (16") and, more preferably, is about eight inches (8"). The tube 144 also preferably comprises an ASA Schedule 40 pipe. The tube 144 preferably includes a stainless steel material, suitable for exposure to high temperatures that range from about three hundred degrees Fahrenheit (300° F.) to about sixteen hundred degrees Fahrenheit (1600° F.). However, the tube 144 could include an alternative high temperature material.

The exhaust duct 140 further includes a relatively small cold air inlet tube 155 that is fixed to and fluidly communicates with the tube 144 (see FIGS. 15 and 16). The air inlet tube 155 presents a cold air inlet 156 (see FIGS. 15 and 22) that receives compressed air from a compressor (not shown) mounted on the chassis of the corresponding vehicle 32,34. The air inlet 156 fluidly communicates with an annulus of the exhaust flue 146 defined between the section 148 and the burner 138 (see FIGS. 21 and 22) to deliver the compressed air stream S2.

The interior diameter dimension of the inlet tube 155 preferably ranges from about one inch (1") to about four inches (4") and, more preferably, is about two inches (2"). The tube 155 also preferably comprises an ASA Schedule 40 pipe. The tube 155 preferably includes a stainless steel material, suitable for exposure to high temperatures that range from about three hundred degrees Fahrenheit (300° F.) to about sixteen hundred degrees Fahrenheit (1600° F.). However, the tube 155 could include an alternative high temperature material.

Figure 22:
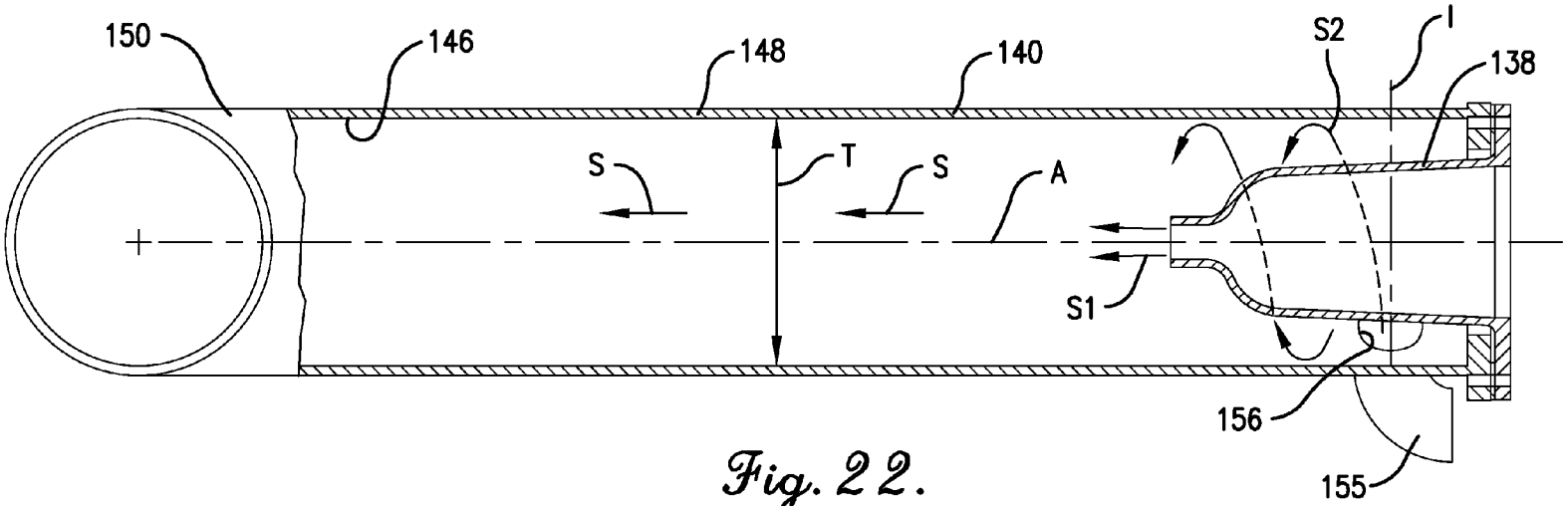
FIG. 22 is a cross section of the burner assembly taken along line 22-22 in FIG. 21.

The inlet tube 155 preferably defines an inlet axis I that is substantially perpendicular to a duct axis A (see FIGS. 21 and 22). The inlet axis I is also preferably radially offset from the duct axis A by an offset dimension C. The offset dimension C preferably ranges from about two inches (2") to about four inches (4") and, more preferably, is about three inches (3"). Also, the ratio of offset dimension C to the radius of tube 144 (i.e. one half of the flue diameter T) preferably ranges from about 1:2 to about 7:8 and, more preferably, is about 3:4.

The illustrated configuration of the inlet tube 155 and tube 144 permits the inlet tube to deliver the compressed air stream S2 so that the stream S2 swirls along the inner surface of the tube 144 while advancing toward the duct outlet 154. This stream S2 has been found to provide sufficient cooling of the burner stream S1 while suitably cooling the burner 138 and the duct 140 during operation. However, for some aspects of the present invention, the inlet tube 155 could be alternatively configured to provide compressed air to the flue 146. For instance, the inlet tube 155 could be alternatively positioned relative to the tube 144 and/or alternatively sized. Furthermore, other components of the illustrated exhaust duct 140 could be alternatively configured without departing from the scope of the present invention.

The exhaust duct 140 is preferably mounted to the enclosure 72 by fixing the duct outlet 154 of the tube 144 and the mounting bracket 142 to the enclosure 72. The illustrated duct outlet 154 is fluidly connected to the inlet opening 130 of the plenum enclosure 72 so that the plenum 128 fluidly communicates with the corresponding burner 138. In this manner, the stream S from the burner 138 is directed into the plenum 128 by flue 146 of the exhaust duct 140. Furthermore, the illustrated duct 140 is preferably oriented so that the linear section 148 extends generally parallel to the longitudinal axis of the enclosure 72 in a rearward direction.

However, for some aspects of the present invention, the duct 140 could be alternatively attached to and/or positioned relative to the enclosure 72. For instance, the duct 140 could be fixed to and supported by the hood frame 70, with the duct outlet 154 being fluidly connected to the inlet opening 130 with another tube section (such as an expandable tube section). It will also be understood that the duct could be alternatively configured and/or mounted where the inlet opening 130 has an alternative configuration (such as an alternative shape or position on the enclosure 72). Also, the exhaust duct 140 could be alternatively oriented relative to the enclosure 72 (e.g., where the exhaust duct 140 extends generally vertically or in a lateral direction transverse to the forward direction F).

In the usual manner, the burner 138 combusts a fuel and air mixture to produce the burner stream S1. The burner stream S1 discharged by the burner 138 has a discharge temperature that preferably ranges from about three hundred degrees Fahrenheit (300° F.) to about sixteen hundred degrees Fahrenheit (1600° F.). The burner 138 preferably includes a housing 158 that presents an air inlet 160, a fuel inlet 162, and a hot gas burner outlet 164 (see FIGS. 15 and 16). The burner 138 also preferably includes a flame ignition device (not shown) to initiate combustion of the fuel and air mixture. The flow of fuel to the fuel inlet 162 is controlled by an adjustable fuel valve (not shown), with each burner 138 having a corresponding fuel valve. The burner 138 is preferably a gas burner designed to combust a gaseous fuel, such as propane. More preferably, the burner 138 comprises a High Velocity Gas Burner, Model No. 4441-A-4-ARRH/T, supplied by Fives North American Combustion, Inc. of Cleveland, Ohio. However, it is within the ambit of the present invention where the burner assembly 74 includes an alternative burner. For instance, the burner 138 could comprise a burner suitable for burning diesel fuel or a dual-fuel burner (such as a burner that can burn either propane or diesel fuel).

The burner 138 is preferably removably mounted to the bracket 142 and tube 144 with threaded fasteners 166 (see FIG. 20). When the burner 138 is mounted, the burner outlet 164 is preferably spaced within the tube 144 (see FIGS. 15 and 16). Also, the burner outlet 164 and the duct outlet 154 cooperatively define an exhaust discharge length dimension L, which is measured along the duct axis A of the exhaust duct 140 (see FIG. 15). The exhaust discharge length dimension L is preferably sized so that the flame discharged by the burner 138 is extinguished in the flue 146 before reaching the duct outlet 154. The exhaust discharge length dimension L preferably ranges from about one foot (1') to about ten feet (10') and, more preferably, ranges from about two feet (2') to about six feet (6'). Most preferably, the length dimension L is about three feet (3').

The burner 138 is powered by introducing fuel into the fuel inlet 162 and supplying compressed air from the compressor of the vehicle 32,34 to the air inlet 160. In the usual manner, the fuel and air are combined within the burner 138 for combustion. Combustion of the fuel and air mixture produces the burner stream S1, which is discharged from the burner outlet 164 and into the flue 146. As described above, the streams S1,S2 become mixed with one another as they advance toward the duct outlet 154 and combine to provide the stream S. The flue 146 of the exhaust duct 140 carries the stream S from the burner 138 to a corresponding one of the enclosures 72. The arrangement of the illustrated exhaust duct 140 and burner 138 enables the burner assembly 74 to operate as part of a hot air heating hood by discharging a heated exhaust stream so that the exhaust stream has no visible flame as it is discharged from the lower margin of the hood.

Turning to FIG. 23, the heating hoods 46,64 each preferably include a propane fuel system 168 that supplies fuel to the corresponding heating zones. The fuel system 168 of heating hood 46 preferably includes the fuel supply 40, a primary fuel regulator PR, a secondary fuel regulator SR, and four (4) final stage fuel regulators R1-R4. The regulators are fluidly connected to one another, the fuel inlets 162 of burners 138 associated with the zones, and the fuel supply 40 with gas lines 170 and gas manifolds 172. In particular, the primary and secondary regulators PR,SR are preferably connected in series to reduce the pressure of fuel from the fuel supply 40. The secondary regulator SR discharges fuel into the manifolds 172 via solenoid valves SV. The solenoid valves SV are preferably operable to control the flow of fuel to zones Z1,Z2 and to zones Z3,Z4, respectively. While the illustrated configuration of solenoid valves SV is preferred, the fuel system 168 could be alternatively configured. For instance, the solenoid valves SV could be configured to control fuel flow to zones Z1,Z3 and zones Z3,Z4, respectively. Furthermore, each zone of the fuel system 168 could be controlled by a separate solenoid valve SV, such that fuel flow to each zone can be controlled independently of the other zones.

The final stage fuel regulators R1-R2 are fluidly connected in parallel with one of the manifolds 172, and the fuel regulators R3-R4 are fluidly connected in parallel with the other one of the manifolds 172. Each regulator R1-R4 receives fuel from the corresponding manifold 172 and discharges the fuel to a corresponding one of the zones Z1-Z4. Furthermore, each regulator R1-R4 is preferably controllable independently of the other regulators R1-R4 to supply fuel to the corresponding zone. In this manner, each regulator R1-R4 preferably controls the fuel pressure and fuel flow rate supplied to the burners 138 of the corresponding zone Z1-Z4 independently of fuel supplied to the other zones. Because the heating hood 64 includes six (6) zones Z1-Z6, the corresponding fuel system 168 preferably includes six (6) final stage fuel regulators that each discharge fuel to the burners 138 of the corresponding zone Z1-Z6.

The primary regulator PR preferably comprises a Type 630 High-Pressure Regulator, Model No. 630-104/78, supplied by Emerson Process Management Regulator Technologies Inc. of McKinney, Tex. The secondary regulator SR preferably comprises a CS800 Series Pressure Reducing Regulator, Model No. CSI00IR-8DC8, supplied by Emerson Process Management Regulator Technologies Inc. of McKinney, Tex. The fuel regulators R1-R4 preferably comprise an Air/Gas Ratio Regulator, Model No. 7218-4, supplied by Fives North American Combustion, Inc. of Cleveland, Ohio. However, it is within the ambit of the present invention where one or more alternative regulators are used in place of any of the above-referenced regulators, or in place of any combination of the above-referenced regulators.

The propane fuel system 168 also preferably includes fuel metering valves (not shown) that provide fuel to the fuel inlet 162 of a respective burner 138. Preferably, each heating hood 46,64 has the same number of burners 138 and metering valves, with each burner 138 receiving fuel from a corresponding, dedicated, fuel metering valve. Each metering valve preferably receives fuel from a corresponding one of the regulators R1-R4. Each fuel metering valve preferably comprises a manually-adjustable limiting orifice valve that is continuously adjustable. However, the fuel system 168 could have an alternative metering valve configuration.

Turning to FIG. 24, the heating hoods 46,64 each preferably include a compressed air system 174 that supplies compressed air to the corresponding heating zones. The compressed air system 174 of heating hood 46 preferably includes a single compressor 176, compressed air plenums P1-P4, and air valves V1-V4. The compressor 176 is fluidly connected to each plenum P1-P4 with an air manifold 178 so that the air manifold 178 distributes compressed air to each plenum P1-P4. Each plenum P1-P4 is preferably fluidly connected in parallel with the air manifold 178. Each plenum P1-P4 preferably defines a chamber (not shown) with a volume that is larger than the internal volume of the manifold 178.

Each plenum P1-P4 is preferably fluidly connected to the air inlets 156,160 associated with a corresponding zone Z1-Z4 by a respective air valve V1-V4 and air lines 180. Consequently, the air valves V1-V4 are preferably arranged in parallel with one another. Each of the air valves V1-V4 preferably comprises a butterfly valve having an eight inch (8") diameter opening. However, it is within the scope of the present invention where the hoods 46,64 include an alternative type and/or size of air valve.

Each air valve V1-V4 is preferably operable to control the pressure and flow rate of compressed air to the air inlets 156,160 associated with the corresponding zone. Furthermore, each air valve V1-V4 is preferably controllable independently of the other air valves to supply compressed air to the corresponding zone. As a result, the air pressure and air flow rate of the compressed air supplied to the air inlets 156,160 of each zone are preferably controllable independently of the compressed air supplied to the other zones. Because the heating hood 64 includes six (6) zones Z1-Z6, the corresponding compressed air system 174 preferably includes six (6) air valves that each discharge fuel to the air inlets 156,160 of the corresponding zone Z1-Z6.

While the air inlets 156,160 of each zone preferably receive compressed air from a common air valve, the compressed air system 174 could be alternatively configured. For instance, the air inlets 156,160 of each burner assembly 74 could be fluidly connected to different air valves that receive compressed air from the compressor 176. Such a configuration could be used to control the pressure and flow of air to the air inlet 156 independently of the air pressure and air flow provided to the air inlet 160.

Each plenum P1-P4 is preferably fluidly connected to a corresponding one of the final stage fuel regulators R1-R4 by air lines 182. Each fuel regulator R1-R4 preferably senses the pressure of compressed air supplied to the corresponding burner 138 and adjusts the fuel flow rate to the burner 138 in order to maintain a predetermined air/fuel ratio for the burner 138. However, the fuel regulator R1-R4 and/or the burner 138 could be alternatively configured to control the air/fuel ratio.

Because the flow of compressed air and the flow of fuel to each zone can be controlled independently of the other zones, each zone Z1-Z4 is configured to be operated independently of the other zones. Again, the heating hood 64 preferably includes heating zones Z1-Z6 (see FIG. 26) that each receive corresponding flows of fuel and compressed air so that each zone Z1-Z6 is operable independently of the other zones.

Operation of all burners 138 is preferably controlled by a user interface (not shown) at the operator station 42,62. The user interface preferably includes switches (not shown) to operate the front zones Z1,Z2 and the rear zones Z3,Z4 of heating hood 46. Similarly, for heating hood 64, the user interface preferably includes switches to operate the front zones Z1,Z2, center zones Z3,Z4, and the rear zones Z5,Z6. The interface also includes another switch (not shown) that operates the flame ignition devices for all burners 138. Each fuel metering valve (not shown) is preferably continuously adjustable to control fuel flow to the burner 138 and to thereby control the burner stream S discharged by each of the burners 138.

Compressed air flow to the air inlet 160 and compressed air flow to the air inlet 156 are provided by the common compressor 176. The compressed air flow from the compressor 176 is preferably regulated by the air valves V1-V4 prior to entering the air inlets 156,160. This configuration permits the operator to selectively adjust the temperature and/or volumetric flow rate of the streams S for each zone Z1-Z4 independently of the streams S for the other zones.

It has been found that the illustrated zone configuration of the heating hoods 46,64 enables the heating hoods 46,64 to apply heat to the road R uniformly across the length and width of the hood, particularly when the hood is exposed to high ambient winds. For instance, when the heating hood 46 is advanced in the forward direction F while the heating hood 46 is exposed to a head wind, the zones Z1-Z4 of the heating hood 46 can be adjusted so that zones Z1,Z2 apply relatively more heat to the road than zones Z3,Z4. In this manner, heat produced by the zones Z1,Z2 can be directed rearwardly by the head wind toward the space below the zones Z3,Z4. Similarly, when the heating hood 46 is exposed to a side wind approaching from the right side of the vehicle 32, the zones Z1-Z4 of the heating hood 46 can be adjusted so that zones Z2,Z4 apply relatively more heat to the road than zones Z1,Z3. Consequently, heat produced by the zones Z2,Z4 can be directed by the side wind toward the space below the zones Z1,Z3.

While the illustrated air inlets 156,160 of each heating hood 46,64 preferably receive compressed air from the compressor 176 associated with the respective vehicle 32,34, the air inlets 156,160 could alternatively receive air for combustion. For instance, multiple compressors (not shown) can be used to provide compressed air to one or both of the air inlets 156,160.

The temperature and/or flow rate of each stream S is preferably controlled at least partly by adjusting the corresponding fuel valve. The fuel value is preferably adjusted to control the amount of energy provided by the corresponding burner assembly 74. Furthermore, the temperature and/or flow rate of the stream S are preferably controlled by controlling the amount of air introduced to the air inlet 160 by the corresponding air valve V1-V4. In a similar manner, the temperature and/or flow rate of the stream S are also preferably controlled by controlling the amount of air introduced to the air inlet 156. It will also be appreciated that the stream S could be controlled by controlling any combination of fuel flow to the fuel inlet 162, air flow to the air inlet 160, and air flow to the air inlet 156.

Importantly, it has been found that providing a controlled stream S2 of compressed air to the air inlet 156 permits the operator to suitably control the temperature of the stream S. Specifically, a predetermined amount of fuel flow is regulated to the burner 138 so that the burner 138 discharges the burner stream S1 with a desired amount of energy. It is also within the ambit of the present invention where the flow rate of compressed air to the air inlet 156 is controlled to adjust the temperature of the stream S without changing the flow rate of fuel to the burner 138.

Control of each stream S is preferably done manually by the operator. However, the principles of the present invention are applicable where the vehicles 32,34 include an automated control system that controls the streams S based upon one or more predetermined operating set points (such as an air temperature measured with a thermocouple adjacent to the road R).

By controlling the temperature and flow rate of each stream S (e.g., by adjusting the fuel valves to control the amount of fuel provided to corresponding burners 138), the zones of the heating hoods 46,64 are configured to precisely control the amount of heat applied to the road R. For instance, the heating hoods 46,64 are configured to vary the amount of heat applied to the road R along a direction transverse to the forward direction F. Similarly, the heating hoods 46,64 are configured to vary the amount of heat applied to the road R along the forward direction F.

In operation, the repaver and preheater vehicles 32,34 are generally operated at the same time to heat the road R, recycle existing road material, and repave the road R using recycled material and new bituminous material. Specifically, during operation, the preheater vehicle 34 is positioned directly in front of the repaver vehicle 32. With the heating hoods 46,64 lowered into the operating position spaced above the road R, the vehicles 32,34 are generally advanced at substantially the same speed and the burner assemblies 74 are operated to heat the road R.

As the vehicles 32,34 are advanced, the heating hood 64 of the preheater vehicle 34 initially heats a section of the road R below the hood 64 to a first elevated temperature greater than the ambient temperature. As the repaver vehicle 32 is advanced so that the heating hood 46 passes over the preheated section of road R, the heating hood 46 heats the preheated section to a second elevated temperature greater than the first elevated temperature. In the usual manner, the second elevated temperature preferably softens an uppermost layer of the road section to the extent that the uppermost road layer can be suitably scarified by the teeth 54 of the scarifier assembly 44.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A heating hood operable to be advanced along a length of bituminous pavement to recycle at least part of the bituminous pavement, said heating hood comprising:

a plurality of burners operable to combust a fuel so that each burner produces a heated exhaust stream; and a plurality of enclosures operable to extend laterally along the pavement, each of said enclosures presenting a plenum that fluidly communicates with a corresponding one of the burners to receive the heated exhaust stream and distribute the heated exhaust stream laterally along the pavement, said enclosures positioned laterally alongside one another and cooperatively presenting a lower margin of the heating hood operable to discharge the heated exhaust streams onto the pavement, with the heated exhaust streams discharged from the lower margin having no visible flame, each of said enclosures presenting a lower outlet that fluidly communicates with the respective plenum to discharge at least part of the respective heated exhaust stream from the respective plenum, each of said enclosures presenting an inlet that fluidly communicates with the respective plenum to permit the heated exhaust stream to flow into the respective plenum from the burner, each of said enclosures including a baffle positioned within the respective plenum and extending laterally to direct the heat exhaust stream within the plenum.

2. The heating hood as claimed in claim 1, each of said enclosures including a pair of adjacent baffles positioned within the respective plenum and extending laterally to direct the heat exhaust stream within the plenum, said pair of adjacent baffles cooperatively defining a lateral chamber therebetween, with the chamber extending from a location adjacent the inlet in a laterally outward direction away from the inlet.

3. The heating hood as claimed in claim 2, said pair of adjacent baffles diverging from each other in the laterally outward direction so that a cross-sectional dimension of the chamber increases in the laterally outward direction.

4. A heating hood operable to be advanced along a length of bituminous pavement to recycle at least part of the bituminous pavement, said heating hood comprising:

a plurality of burners operable to combust a fuel so that each burner produces a heated exhaust stream;

a plurality of enclosures operable to extend laterally along the pavement, each of said enclosures presenting a plenum that fluidly communicates with a corresponding one of the burners to receive the heated exhaust stream and distribute the heated exhaust stream laterally along the pavement, said enclosures positioned laterally alongside one another and cooperatively presenting a lower margin of the heating hood operable to discharge the heated exhaust streams onto the pavement, with the heated exhaust streams discharged from the lower margin having no visible flame, each of said enclosures presenting a lower outlet that fluidly communicates with the respective plenum to discharge at least part of the respective heated exhaust stream from the respective plenum; and a hood frame, said plenum enclosures being shiftably attached to the hood frame to permit up and down movement of the outlet relative to the hood frame.

5. The heating hood as claimed in claim 4, each of said enclosures including a perforated lower wall that defines at least part of the lower margin of the heating hood and presents a plurality of perforations that cooperatively provide the lower outlet.

6. The heating hood as claimed in claim 4, an adjacent pair of said plenum enclosures cooperatively presenting a lateral gap therebetween, with the gap permitting relative movement between each of the adjacent pair of plenum enclosures.

7. A heating hood operable to be advanced along a length of bituminous pavement to recycle at least part of the bituminous pavement, said heating hood comprising:

a plurality of burners operable to combust a fuel so that each burner produces a heated exhaust stream;

a plurality of enclosures operable to extend laterally along the pavement, each of said enclosures presenting a plenum that fluidly communicates with a corresponding one of the burners to receive the heated exhaust stream and distribute the heated exhaust stream laterally along the pavement, said enclosures positioned laterally alongside one another and cooperatively presenting a lower margin of the heating hood operable to discharge the heated exhaust streams onto the pavement, with the heated exhaust streams discharged from the lower margin having no visible flame; and a hood frame, said plenum enclosures being shiftably attached to the hood frame to permit up and down movement of the lower margin relative to the hood frame.

8. The heating hood as claimed in claim 7, each of said enclosures presenting an inlet that fluidly communicates with the respective plenum to permit the heated exhaust stream to flow into the respective plenum from the burner.

9. The heating hood as claimed in claim 7; and exhaust ducts that fluidly interconnect each burner and a corresponding one of the enclosures to carry the exhaust stream to the corresponding plenum.

10. The heating hood as claimed in claim 9, each of said exhaust ducts being mounted on and supported by the corresponding one of the enclosures.

11. The heating hood as claimed in claim 7; and an exhaust duct that fluidly interconnects one of the burners and one of the enclosures to carry the exhaust stream to the corresponding plenum.

12. The heating hood as claimed in claim 11, said one enclosure presenting an enclosure inlet that fluidly communicates with the respective plenum to permit the heated exhaust stream to flow into the respective plenum from the burner, said exhaust duct presenting a duct outlet, with the exhaust duct being mounted so that the enclosure inlet of the one enclosure fluidly communicates with the duct outlet.

13. The heating hood as claimed in claim 12, said exhaust duct being mounted on and supported by the one enclosure.

14. The heating hood as claimed in claim 12, said exhaust duct presenting a duct inlet spaced laterally from the duct outlet, with the duct inlet at least partly receiving the burner.

15. The heating hood as claimed in claim 12, said burner presenting a burner outlet that discharges the exhaust stream, said burner outlet being spaced laterally from the duct outlet.

16. The heating hood as claimed in claim 15, said burner outlet and said duct outlet cooperatively defining an exhaust discharge length dimension, with the exhaust discharge length dimension being sized so that the flame discharged by the burner is extinguished before reaching the duct outlet.

17. The heating hood as claimed in claim 16, said exhaust discharge length dimension ranging from about two feet to about six feet.

18. The heating hood as claimed in claim 7;

multiple heating zones each including at least one of the enclosures and at least one of the burners; and a fuel system including multiple regulators fluidly connected in parallel with one another so that each regulator supplies fuel, independently of the other regulators, to the at least one burner associated with a corresponding one of the heating zones.

19. The heating hood as claimed in claim 18; and a compressed air system including multiple air valves fluidly connected in parallel with one another so that each air valve supplies compressed air, independently of the other air valves, to the at least one burner associated with a corresponding one of the heating zones.

20. A heating hood operable to be advanced along a length of bituminous pavement to recycle at least part of the bituminous pavement, said heating hood comprising:

a plurality of burners operable to combust a fuel so that each burner produces a heated exhaust stream;

a plurality of enclosures operable to extend laterally along the pavement, each of said enclosures presenting a plenum that fluidly communicates with a corresponding one of the burners to receive the heated exhaust stream and distribute the heated exhaust stream laterally along the pavement, said enclosures positioned laterally alongside one another and cooperatively presenting a lower margin of the heating hood operable to discharge the heated exhaust streams onto the pavement, with the heated exhaust streams discharged from the lower margin having no visible flame; and a hood frame that supports the enclosures, each of said enclosures including a perforated lower wall that defines an outlet presented by the lower margin of the heating hood, with the lower walls being shiftable up and down relative to the hood frame.

21. The heating hood as claimed in claim 20, said plenum enclosures being shiftably attached to the hood frame to move up and down relative to the hood frame.

22. A hot air heating hood operable to be advanced along a length of bituminous pavement to recycle at least part of the bituminous pavement, said heating hood assembly comprising:

a hood structure defining a lower discharge margin operable to overlie the pavement;

a plurality of burners operable to combust a fuel so that each burner produces a heated exhaust stream; and a plurality of elongated exhaust ducts presenting duct outlets that fluidly communicate with the lower discharge margin, each of said exhaust ducts fluidly communicating with a corresponding one of the burners to receive and carry the respective heated exhaust stream to the lower discharge margin, with the lower discharge margin being operable to discharge the heated exhaust streams onto the pavement, and with the heated exhaust streams discharged from the lower discharge margin having no visible flame, said hood structure presenting a plenum fluidly communicating with said exhaust ducts, said hood structure presenting a lower outlet that fluidly communicates with the plenum to discharge at least part of the heated exhaust streams from the plenum, said hood structure including a plurality of enclosures, with each of said enclosures presenting an inlet that fluidly communicates with the plenum and at least one of the exhaust ducts to permit the respective heated exhaust stream to flow into the plenum from a respective burner.

23. The heating hood as claimed in claim 22, said hood structure including a perforated lower wall that defines at least part of the lower discharge margin and presents a plurality of perforations that cooperatively provide the lower outlet of the hood structure.

24. The heating hood as claimed in claim 22, said hood structure including a baffle positioned within the plenum and extending laterally to direct the respective heat exhaust stream within the plenum.

25. The heating hood as claimed in claim 24, said hood structure including a pair of adjacent baffles positioned within the plenum and extending laterally to direct the respective heat exhaust stream within the plenum, said pair of adjacent baffles cooperatively defining a lateral chamber therebetween, with the chamber extending from a location adjacent the inlet in a laterally outward direction away from the inlet.

26. The heating hood as claimed in claim 25, said pair of adjacent baffles diverging from each other in the laterally outward direction so that a cross-sectional dimension of the chamber increases in the laterally outward direction.

27. The heating hood as claimed in claim 22, said exhaust ducts being mounted on and supported by the hood structure.

28. The heating hood as claimed in claim 27, each of said exhaust ducts presenting a duct inlet spaced laterally from the duct outlet, with each duct inlet at least partly receiving the corresponding one of the burners.

29. The heating hood as claimed in claim 27, each of said burners presenting a burner outlet that discharges the exhaust stream, each of said burner outlets being spaced laterally from the corresponding duct outlet.

30. The heating hood as claimed in claim 29, each of said burner outlets and said corresponding duct outlets cooperatively defining an exhaust discharge length dimension, with the exhaust discharge length dimension being sized so that the flame discharged by each of the burners is extinguished before reaching the corresponding duct outlet.

31. The heating hood as claimed in claim 22, said enclosures positioned laterally alongside one another and cooperatively presenting the lower discharge margin, said exhaust ducts positioned alongside one another and each fluidly connected to a respective one of the enclosures.

32. The heating hood as claimed in claim 22;

multiple heating zones each including at least one of the exhaust ducts and at least one of the burners; and a fuel system including multiple regulators fluidly connected in parallel with one another so that each regulator supplies fuel, independently of the other regulators, to the at least one burner associated with a corresponding one of the heating zones.

33. The heating hood as claimed in claim 32; and a compressed air system including multiple air valves fluidly connected in parallel with one another so that each air valve supplies compressed air, independently of the other air valves, to the at least one burner associated with a corresponding one of the heating zones.

* * * * *